US009927739B2

(12) United States Patent
Yano et al.

(10) Patent No.: US 9,927,739 B2
(45) Date of Patent: Mar. 27, 2018

(54) POWDER CONTAINER, IMAGE FORMING APPARATUS, AND NOZZLE RECEIVER

(71) Applicants: Keiichi Yano, Shizuoka (JP); Junji Yamabe, Shizuoka (JP); Ryoichi Teranishi, Shizuoka (JP); Yuuta Tanaka, Shizuoka (JP); Seiji Terazawa, Shizuoka (JP)

(72) Inventors: Keiichi Yano, Shizuoka (JP); Junji Yamabe, Shizuoka (JP); Ryoichi Teranishi, Shizuoka (JP); Yuuta Tanaka, Shizuoka (JP); Seiji Terazawa, Shizuoka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/321,910

(22) PCT Filed: Jun. 30, 2015

(86) PCT No.: PCT/JP2015/069368
§ 371 (c)(1),
(2) Date: Dec. 23, 2016

(87) PCT Pub. No.: WO2016/002966
PCT Pub. Date: Jan. 7, 2016

(65) Prior Publication Data

US 2017/0139350 A1 May 18, 2017

(30) Foreign Application Priority Data

Jul. 4, 2014 (JP) ..... 2014-138841

(51) Int. Cl.
*G03G 15/08* (2006.01)

(52) U.S. Cl.
CPC ..... *G03G 15/0877* (2013.01)

(58) Field of Classification Search
CPC ..... G03G 15/0877
See application file for complete search history.

(56) References Cited

U.S. PATENT DOCUMENTS 7,088,942 B2 8/2006 Minagawa
9,581,937 B2 2/2017 Hosokawa et al.
(Continued)

FOREIGN PATENT DOCUMENTS

EP 1 306 730 A2 5/2003
JP 2013-057884 3/2013
(Continued)

OTHER PUBLICATIONS

Extended European Search Report dated May 19, 2017 in Patent Application No. 15814107. 7.
(Continued)

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

According to an embodiment, when a nozzle insertion member is detached from a powder container, an engaging portion and an engaged portion are disengaged from each other by resiliently displacing the engaging portion in a direction in which the engaging portion is disengaged from the engaged portion. Therefore, it is possible to reduce a stress applied to the powder container and the nozzle insertion member at the time of attachment and detachment of the nozzle insertion member. Consequently, it becomes possible to easily detach the nozzle insertion member from the powder container.

19 Claims, 15 Drawing Sheets

(56) References Cited

U.S. PATENT DOCUMENTS

| | | | | |
|---|---|---|---|---|
| 2003/0081968 | A1 | 5/2003 | Minagawa | |
| 2006/0099012 | A1 | 5/2006 | Kita et al. | |
| 2007/0065183 | A1* | 3/2007 | Tomita | G03G 15/0877 399/258 |
| 2007/0140747 | A1 | 6/2007 | Kita et al. | |
| 2007/0147902 | A1 | 6/2007 | Taguchi et al. | |
| 2007/0154244 | A1 | 7/2007 | Taguchi et al. | |
| 2007/0160394 | A1 | 7/2007 | Taguchi et al. | |
| 2007/0177886 | A1 | 8/2007 | Taguchi et al. | |
| 2007/0212119 | A1 | 9/2007 | Kurenuma et al. | |
| 2010/0284710 | A1 | 11/2010 | Sasaki et al. | |
| 2010/0296847 | A1 | 11/2010 | Kurenuma et al. | |
| 2011/0002713 | A1 | 1/2011 | Taguchi et al. | |
| 2011/0020039 | A1 | 1/2011 | Mitsuishi et al. | |
| 2011/0286771 | A1 | 11/2011 | Taguchi et al. | |
| 2012/0213555 | A1* | 8/2012 | Komatsu | G03G 15/087 399/262 |
| 2012/0301188 | A1 | 11/2012 | Yamabe et al. | |
| 2012/0321341 | A1 | 12/2012 | Hori et al. | |
| 2013/0230338 | A1 | 9/2013 | Kubo et al. | |
| 2013/0272750 | A1 | 10/2013 | Matsumoto et al. | |
| 2014/0029973 | A1 | 1/2014 | Terazawa et al. | |
| 2014/0241757 | A1 | 8/2014 | Kikuchi et al. | |
| 2014/0270859 | A1 | 9/2014 | Hosokawa et al. | |
| 2014/0348551 | A1 | 11/2014 | Yamabe et al. | |
| 2016/0033898 | A1 | 2/2016 | Yamabe et al. | |
| 2016/0161885 | A1 | 6/2016 | Hosokawa et al. | |
| 2017/0108799 | A1 | 4/2017 | Hosokawa et al. | |

FOREIGN PATENT DOCUMENTS

| | | |
|---|---|---|
| JP | 5435380 | 12/2013 |
| WO | WO 2013/077474 A1 | 5/2013 |
| WO | 2014/142353 A1 | 9/2014 |
| WO | 2015/141861 A1 | 9/2015 |

OTHER PUBLICATIONS

International Search Report dated Sep. 15, 2015 in PCT/JP2015/069368 filed on Jun. 30, 2015.

* cited by examiner

POWDER CONTAINER, IMAGE FORMING APPARATUS, AND NOZZLE RECEIVER

TECHNICAL FIELD

The present invention relates to a powder container for storing developer that is powder used in an image forming apparatus, such as a printer, a facsimile machine, a copier, or a multifunction peripheral with multiple functions of the printer, the facsimile machine, and the copier, and an image forming apparatus including the powder container.

BACKGROUND ART

In an electrophotography image forming apparatus, a powder conveying device (toner replenishing device) supplies (replenishes) toner that is developer from a toner container serving as a powder container containing the developer that is powder to a developing device. The toner container includes a rotatable cylindrical powder storage, a nozzle insertion member attached to the powder storage, an opening provided on the nozzle insertion member, and an opening/closing member that moves to a closing position at which the opening is closed and to an opening position at which the opening is opened along with insertion of a conveying nozzle of the powder conveying device. In the image forming apparatus configured as described above, the opening/closing member is moved to the opening position by the conveying nozzle inserted in the toner container along with attachment of the toner container to the powder conveying device. Accordingly, the toner in the toner container is supplied to the conveying nozzle. An example of the image forming apparatus including the toner container configured as described above is disclosed in, for example, Japanese Patent No. 5435380.

In the conventional configuration, the nozzle insertion member is press fitted to the powder storage. Therefore, when recycling (re-replenishing of toner or the like) is to be performed, it is necessary to detach the nozzle insertion member from the powder storage. However, at the time of detachment, the nozzle insertion member and the powder storage are stressed, so that they may be damaged or may not be detached. Consequently, recycling may be impossible.

It is an object of the present invention to easily detach the nozzle insertion member from the powder storage.

SUMMARY OF THE INVENTION

According to an embodiment, when a nozzle insertion member is detached from a powder container, an engaging portion and an engaged portion are disengaged from each other by resiliently displacing the engaging portion in a direction in which the engaging portion is disengaged from the engaged portion. Therefore, it is possible to reduce a stress applied to the powder container and the nozzle insertion member at the time of attachment and detachment of the nozzle insertion member. Consequently, it becomes possible to easily detach the nozzle insertion member from the powder container.

DESCRIPTION OF EMBODIMENTS

Figure 1:
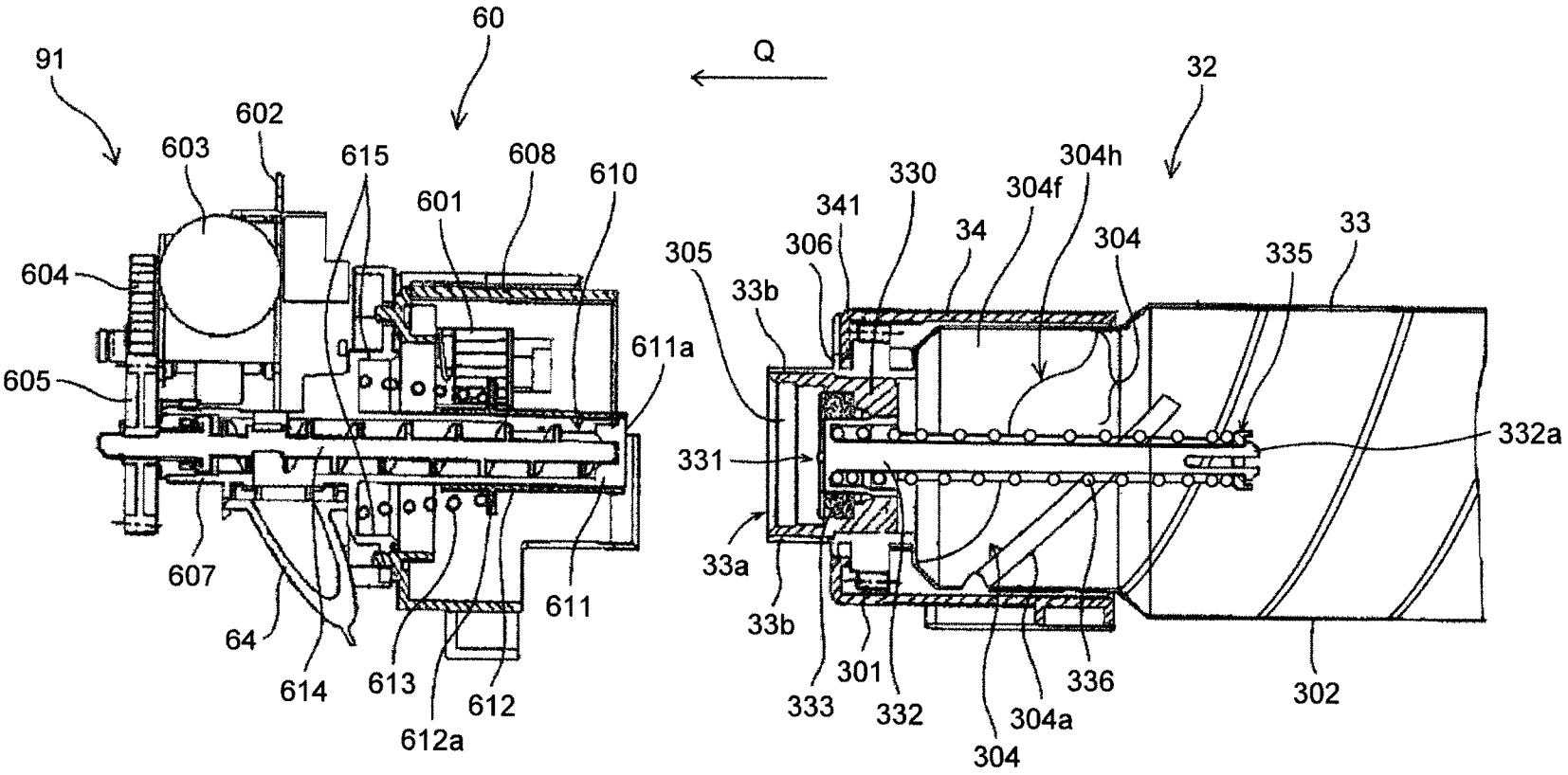
FIG. 1 is an explanatory cross-sectional view of a powder conveying device (toner replenishing device) before a powder container according to an embodiment of the present invention is attached and the powder container.

Embodiments of the present invention will be described below with reference to the accompanying drawings. In the drawings, Y, M, C, and K are symbols appended to components corresponding to yellow, magenta, cyan, and black, respectively, and will be omitted appropriately.

Figure 2:
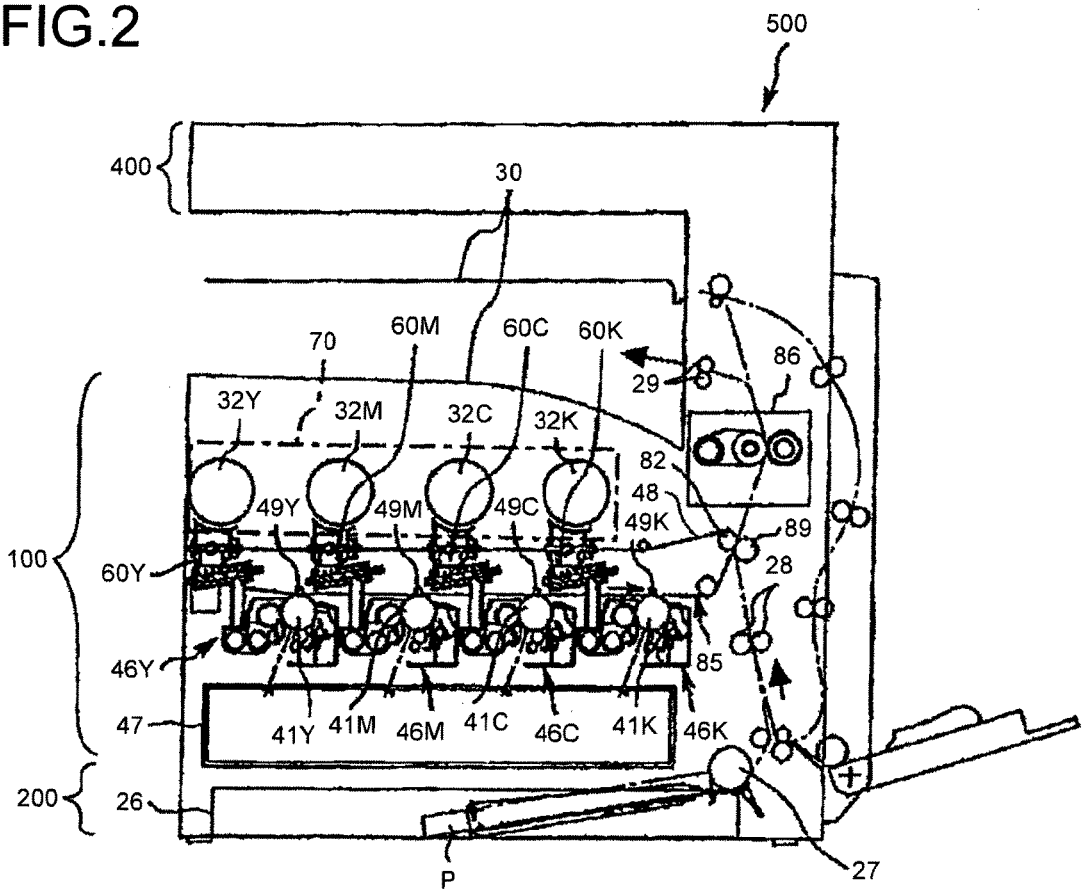
FIG. 2 is an overall configuration diagram of an image forming apparatus according to the embodiment.

FIG. 2 is an overall configuration diagram of an electrophotography tandem-type color copier (hereinafter, referred to as "a copier 500") serving as an image forming apparatus according to an embodiment. The image forming apparatus may be a monochrome copier; The image forming apparatus may be a printer, a facsimile machine, or a multifunction peripheral with multiple functions of a copier, a printer, and a facsimile machine, instead of the copier.

The copier 500 mainly includes a copier main-body (hereinafter, referred to as "a printer 100"), a sheet feed table (hereinafter, referred to as "a sheet feeder 200"), and a scanner section (hereinafter, referred to as "a scanner 400") mounted on the printer 100.

Four toner containers 32Y, 32M, 32C, 32K serving as powder containers corresponding to colors of yellow, magenta, cyan, and black are detachably (replaceably) attached to a toner container holder 70 serving as a container holding section provided in the upper part of the printer 100. An intermediate transfer device 85 is arranged below the toner container holder 70.

The intermediate transfer device 85 includes an intermediate transfer belt 48 serving as an intermediate transfer medium, four primary-transfer bias rollers 49Y, 49M, 49C, and 49K, a secondary-transfer backup roller 82, multiple tension rollers, an intermediate-transfer cleaning device, and the like. The intermediate transfer belt 48 is stretched and supported by multiple rollers. The intermediate transfer belt 48 endlessly moves counterclockwise in FIG. 2 along with rotation of the secondary-transfer backup roller 82 serving as one of the rollers.

In the printer 100, four image forming sections 46Y, 46M, 46C, and 46K corresponding to the respective colors are arranged in tandem so as to face the intermediate transfer belt 48. Four toner replenishing devices 60Y, 60M, 60C, and 60K serving as powder replenishing (supply) devices corresponding to the four toner containers 32Y, 32M, 32C, and 32K of the four colors are arranged below the toner containers 32Y, 32M, 32C, and 32K, respectively. The toner replenishing devices 60Y, 60M, 60C, and 60K respectively supply (replenish) toner that is powder developer contained in the toner containers 32Y, 32M, 32C, and 32K to developing devices of the image forming sections 46Y, 46M, 46C, and 46K for the respective colors. In the embodiment, the four image forming sections 46Y, 46M, 46C, and 46K form an image forming unit.

The printer 100 includes an exposing device 47 serving as a latent-image forming means below the four image forming sections 46Y, 46M, 46C, and 46K. The exposing device 47 exposes and scans the surfaces of photoconductors 41Y, 41M, 41C, and 41K serving as image bearers (to be described later) with light based on image information of an original image read by the scanner 400, so that electrostatic latent images are formed on the surfaces of the photoconductors 41Y, 41M, 41C, and 41K. The image information may be input from an external apparatus, such as a personal computer, connected to the copier 500, instead of being read by the scanner 400.

In the embodiment, a laser beam scanning system using a laser diode is employed as the exposing device 47. However, other configurations, such as a configuration including an LED array, may be employed as the exposing means.

Figure 3:
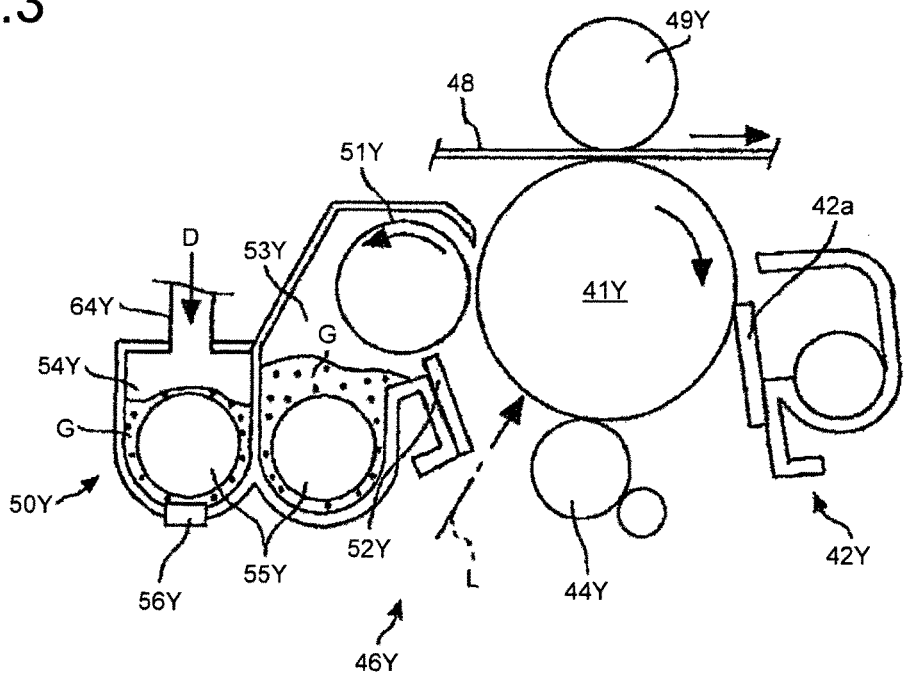
FIG. 3 is a schematic diagram illustrating a configuration of an image forming section of the image forming apparatus illustrated in FIG. 2.

FIG. 3 is a schematic diagram illustrating an overall configuration of the image forming section 46Y corresponding to yellow.

The image forming section 46Y includes the drum-shaped photoconductor 41Y. The image forming section 46Y includes a charging roller 44Y serving as a charging device, a developing device 50Y serving as a developing means, a photoconductor cleaning device 42Y, a neutralizing device, and the like, all of which are arranged around the photoconductor 41Y. Image forming processes (a charging process, an exposing process, a developing process, a transfer process, and a cleaning process) are performed on the photoconductor 41Y. Consequently, a yellow toner image is formed on the photoconductor 41Y.

The other three image forming sections 46M, 46C, and 46K have almost the same configurations as the image forming section 46Y for yellow except that colors of toner to be used are different. Therefore, toner images corresponding to the respective toner colors are formed on the photoconductors 41M, 41C, and 41K. Hereinafter, explanation of only the image forming section 46Y for yellow will be given, and explanation of the other three image forming sections 46M, 46C, and 46K will be omitted appropriately.

The photoconductor 41Y is rotated clockwise in FIG. 3 by a driving motor. The surface of the photoconductor 41Y is uniformly charged at a position facing the charging roller 44Y (charging process). Subsequently, the surface of the photoconductor 41Y reaches a position of irradiation with laser light L emitted by the exposing device 47. At this position, exposure scanning is performed and an electrostatic latent image for yellow is formed (exposing process). The surface of the photoconductor 41Y then reaches a position facing the developing device 50Y. At this position, the electrostatic latent image is developed with yellow toner and a yellow toner image is formed (developing device).

As illustrated in FIG. 2, the four primary-transfer bias rollers 49Y, 49M, 49C, and 49K of the intermediate transfer device 85 and the photoconductors 41Y, 41M, 41C, and 41K sandwich the intermediate transfer belt 48, so that primary transfer nips are formed. A transfer bias with polarity opposite to the polarity of toner is applied to each of the primary-transfer bias rollers 49Y, 49M, 49C, and 49K.

As illustrated in FIG. 3, the surface of the photoconductor 41Y, on which the toner image is formed through the developing process, reaches the primary transfer nip facing the primary-transfer bias roller 49Y across the intermediate transfer belt 48. At the primary transfer nip, the toner image on the photoconductor 41Y is transferred to the intermediate transfer belt 48 (primary transfer process). At this time, a slight amount of non-transferred toner remains on the photoconductor 41Y. The surface of the photoconductor 41Y, from which the toner image has been transferred to the intermediate transfer belt 48 at the primary transfer nip, reaches a position facing the photoconductor cleaning device 42Y. At this position, the non-transferred toner remaining on the photoconductor 41Y is mechanically collected by a cleaning blade 42*a* included in the photoconductor cleaning device 42Y (cleaning process). The surface of the photoconductor 41Y finally reaches a position facing the neutralizing device. At this position, a residual potential on the photoconductor 41Y is removed. In this way, a series of the image forming processes performed on the photoconductor 41Y is completed.

The above described image forming processes are also performed on the other image forming sections 46M, 46C, and 46K in the same manner as in the image forming section 46Y for yellow. Specifically, the exposing device 47 arranged below the image forming sections 46M, 46C, and 46K emits laser light L based on the image information toward the photoconductors 41M, 41C, and 41K of the image forming sections 46M, 46C, and 46K. More specifically, the exposing device 47 emits the laser light L from a light source and irradiates each of the photoconductors 41M, 41C, and 41K with the laser light L via multiple optical elements while performing scanning with the laser light L by a rotating polygon mirror. Subsequently, toner images of the respective colors are formed on the photoconductors 41M, 41C, and 41K through the developing process, and the toner images are transferred to the intermediate transfer belt 48.

At this time, the intermediate transfer belt 48 runs counterclockwise in FIG. 2 and sequentially passes through the primary transfer nips of the primary-transfer bias rollers 49Y, 49M, 49C, and 49K. Therefore, the toner images of the respective colors on the photoconductors 41Y, 41M, 41C, and 41K are primary-transferred to the intermediate transfer belt 48 in a superimposed manner. Consequently, a color toner image is formed on the intermediate transfer belt 48.

The intermediate transfer belt 48, on which the color toner image is formed by the superimposed toner images of the four colors, reaches a position facing a secondary-transfer roller 89. At this position, the secondary-transfer backup roller 82 and the secondary-transfer roller 89 sandwich the intermediate transfer belt 48, so that a secondary transfer nip is formed. The color toner image formed on the intermediate transfer belt 48 is transferred to a recording medium P, such as a sheet of paper, conveyed to the position of the secondary transfer nip, due to the action of a transfer bias applied to the secondary-transfer backup roller 82, for example. At this time, non-transferred toner that has not been transferred to the recording medium P remains on the intermediate transfer belt 48. The intermediate transfer belt 48 that has passed through the secondary transfer nip reaches the position of an intermediate-transfer cleaning device. At this position, the non-transferred toner remaining on the surface is collected. In this way, a series of transfer processes performed on the intermediate transfer belt 48 is completed.

Movement of the recording medium P will be explained below.

The recording medium P is conveyed to the secondary transfer nip from a feed tray 26 provided in the sheet feeder 200 arranged below the printer 100 via a feed roller 27, a registration roller pair 28, and the like. Specifically, multiple recording media P are stacked in the feed tray 26. When the feed roller 27 is rotated counterclockwise in FIG. 2, the topmost recording medium P is fed to a nip between two rollers of the registration roller pair 28.

The recording medium P conveyed to the registration roller pair 28 temporarily stops at the position of the nip between the rollers of the registration roller pair 28, the rotation of which is being suspended. Then, the registration roller pair 28 is rotated to convey the recording medium P toward the secondary transfer nip in accordance with the timing at which the color toner image on the intermediate transfer belt 48 reaches the secondary transfer nip. Consequently, a desired color image is transferred to the recording medium P.

The recording medium P, on which the color toner image has been transferred at the secondary transfer nip, is conveyed to the position of a fixing device 86. In the fixing device 86, the color toner image transferred on the surface of the recording medium P is fixed to the recording medium P by heat and pressure applied by a fixing belt and a pressing roller. The recording medium P that has passed through the fixing device 86 is discharged to the outside of the apparatus via a nip between rollers of a discharge roller pair 29. The recording medium P discharged to the outside of the apparatus by the discharge roller pair 29 is sequentially stacked, as an output image, on a stack section 30. In this way, a series of image forming processes in the copier 500 is completed.

A configuration and operation of the developing device 50 in the image forming section 46 will be explained in detail below. In the following, the image forming section 46Y for yellow will be explained by way of example. However, the image forming sections 46M, 46C, and 46K for the other colors have the same configurations and perform the same operation.

As illustrated in FIG. 3, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y. The doctor blade 52Y faces the developing roller 51Y. The two developer conveying screws 55Y are arranged inside two developer accommodating sections, that is, first and second developer accommodating sections 53Y and 54Y. The developing roller 51Y includes a magnet roller disposed inside thereof, a sleeve that rotates around the magnet roller, and the like. Two-component developer G containing carrier and toner is stored in the first developer accommodating section 53Y and the second developer accommodating section 54Y. The second developer accommodating section 54Y communicates with a toner dropping passage 64Y via an opening provided in the upper side thereof. The toner density sensor 56Y detects a toner density in the developer G stored in the second developer accommodating section 54Y.

The developer G in the developing device 50 circulates between the first developer accommodating section 53Y and the second developer accommodating section 54Y while being stirred by the two developer conveying screws 55Y. The developer G in the first developer accommodating section 53Y is supplied to and borne on the surface of the sleeve of the developing roller 51Y due to a magnetic field generated by the magnet roller in the developing roller 51Y while the developer G is being conveyed by one of the developer conveying screws 55Y. The sleeve of the developing roller 51Y rotates counterclockwise as indicated by an arrow in FIG. 3. The developer G borne on the developing roller 51Y moves on the developing roller 51Y along with the rotation of the sleeve. At this time, the toner in the developer G electrostatically adheres to the carrier by being charged to the potential opposite to the polarity of the carrier due to triboelectric charging with the carrier in the developer G, and is borne on the developing roller 51Y together with the carrier that is attracted by the magnetic field generated on the developing roller 51Y.

The developer G borne on the developing roller 51Y is conveyed in an arrow direction in FIG. 3 and reaches a doctor section where the doctor blade 52Y and the developing roller 51Y face each other. The amount of the developer G on the developing roller 51Y is regulated and adjusted to an appropriate amount when the developer G passes through the doctor section. Subsequently, the developer G is conveyed to a development area facing the photoconductor 41Y. In the development area, the toner in the developer G adheres to the latent image on the photoconductor 41Y by a developing electric field generated between the developing roller 51Y and the photoconductor 41Y. The developer G remaining on the surface of the developing roller 51Y that has passed through the development area reaches the upper side of the first developer accommodating section 53Y along with the rotation of the sleeve. At this position, the developer G is separated from the developing roller 51Y.

The developer G in the developing device 50Y is adjusted so that the toner density falls within a predetermined range. Specifically, toner contained in the toner container 32Y is replenished to the second developer accommodating section 54Y by the toner replenishing device 60Y (to be described later) through the toner dropping passage 64Y in accordance with the amount of toner consumed from the developer G in the developing device 50Y through the development process. The toner replenished to the second developer accommodating section 54Y circulates between the first developer accommodating section 53Y and the second developer accommodating section 54Y while being mixed and stirred with the developer G by the two developer conveying screws 55Y.

Next, the toner replenishing devices 60Y, 60M, 60C, and 60K will be described.

Figure 4:
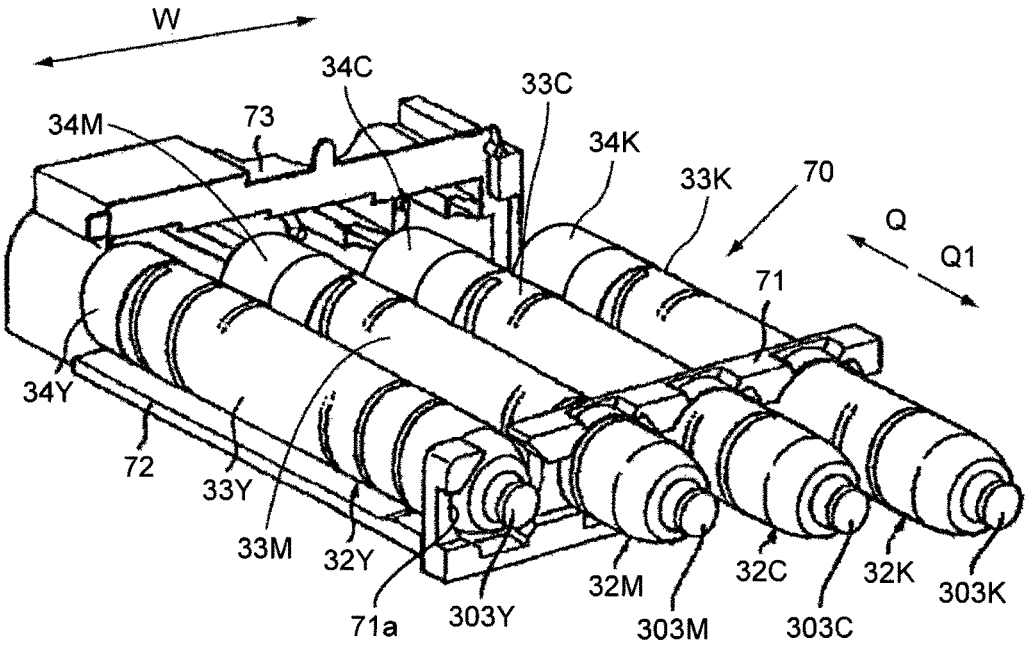
FIG. 4 is a schematic perspective view illustrating a state in which the powder containers are attached to a container holding section.
Figure 5:
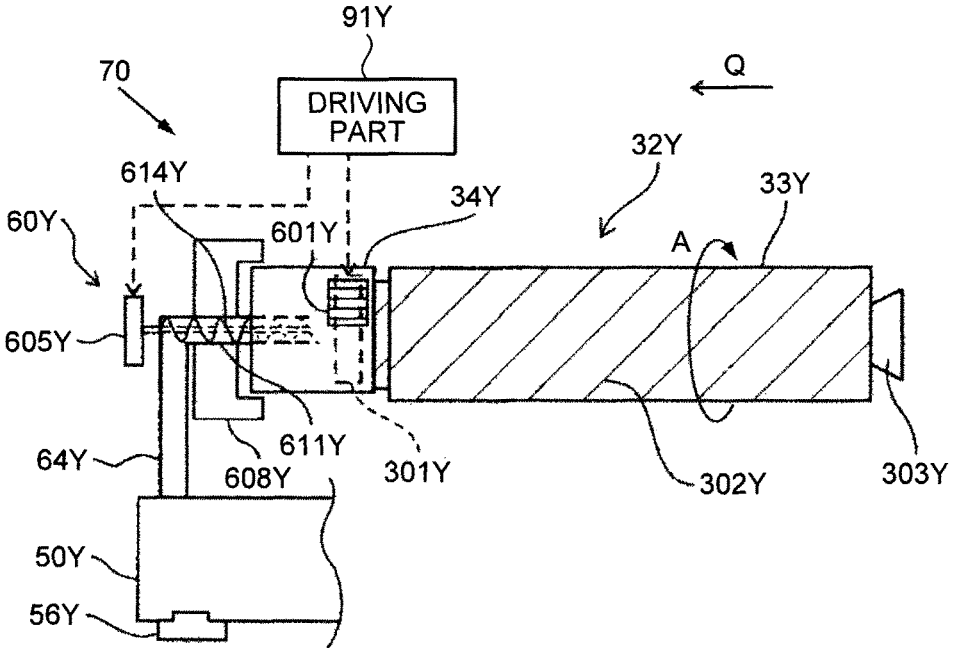
FIG. 5 is a schematic diagram illustrating a state in which the powder container is attached to the powder conveying device of the image forming apparatus illustrated in FIG. 2.

FIG. 4 is a schematic perspective view illustrating a state in which the four toner containers 32Y, 32M, 32C, and 32K are attached to the toner container holder 70. FIG. 5 is a schematic diagram illustrating a state in which the toner container 32Y is attached to the toner replenishing device 60Y. The toner replenishing devices 60Y, 60M, 60C, and 60K for the respective colors have the same configurations except that the colors of toner are different. Therefore, in FIG. 5, explanation of only the toner replenishing device 60Y and the toner container 32Y for yellow will be given, and explanation of the toner replenishing devices 60M, 60C, and 60K and the toner containers 32M, 32C, and 32K for the other three colors will be omitted appropriately. When a configuration varies depending on the colors, a symbol Y, M, C, or K representing a specific color is used. When a configuration does not vary depending on the colors or a configuration is common to all of the colors, a symbol Y, M, C, or K may be used or all of the symbols may be omitted appropriately. In FIG. 4, an arrow Q indicates an attachment direction in which the toner containers 32 of the respective colors are attached to the toner replenishing devices 60, and Q1 indicates a detachment direction in which the toner containers 32 of the respective colors are detached from the toner replenishing devices 60.

The yellow toner contained in the toner container 32Y among the toner containers 32Y, 32M, 32C, and 32K for the respective colors attached to the toner container holder 70 of the printer 100 illustrated in FIG. 4 is appropriately replenished to the developing device in accordance with the consumption of toner in the developing device 50 as illustrated in FIG. 5. At this time, the toner in the toner container 32Y is replenished by the toner replenishing device 60Y. The toner replenishing device 60Y includes the toner container holder 70, a conveying nozzle 611Y serving as a nozzle, a conveying screw 614Y serving as a main body conveyor, the toner dropping passage 64Y, a driving part 91Y serving as a container rotating part, and the like. The toner replenishing devices for the other colors have the same configurations. When a user performs attachment operation to push the toner container 32Y in the attachment direction Q in FIG. 5, the toner container 32Y moves inside the toner container holder 70 of the printer 100. Along with this attachment operation, the conveying nozzle 611Y of the toner replenishing device 60Y is inserted from a front side of the toner container 32Y in the attachment direction Q. Therefore, the toner container 32Y and the conveying nozzle 611Y communicate with each other. A configuration for the communication along with the attachment operation will be described in detail later.

The toner container 32Y may be referred to as a toner bottle. The toner container 32Y mainly includes a container cover 34Y serving as a container front end cover or a held portion and an approximately cylindrical container body 33Y serving as a powder storage. The container cover 34Y is non-rotatably held by the toner container holder 70. The container body 33Y is integrated with a container gear 301Y serving a container-side gear. The container body 33Y is rotatably held by the container cover 34Y. In FIG. 5, a setting cover 608Y is a part of, a container cover receiving section 73 of the toner container holder 70.

As illustrated in FIG. 4, the toner container holder 70 mainly includes the container cover receiving section 73, a container receiving section 72, and an insertion hole part 71. The container cover receiving section 73 is a section for holding the container cover 34Y and the container body 33Y of the toner container 32Y. The container receiving section 72 is a section for supporting the container body 33Y of the toner container 32Y. An insertion hole 71*a* used in the attachment operation of the toner container 32Y is defined by the insertion hole part 71. When a main-body cover arranged on the front side of the copier 500 (the front side in the direction normal to the sheet of FIG. 2) is opened, the insertion hole part 71 of the toner container holder 70 is exposed. Then, attachment/detachment operation of the toner containers 32Y, 32M, 32C, and 32K (attachment/detachment operation with the longitudinal direction of the toner containers 32 taken as an attachment/detachment direction) is performed from the front side of the copier 500 while the toner containers 32Y, 32M, 32C, and 32K are oriented such that their longitudinal directions are parallel to the horizontal direction.

The container receiving section 72 is provided such that its longitudinal length becomes approximately the same as the longitudinal lengths of the container bodies 33Y, 33M, 33C, and 33K of the respective colors. The container cover receiving section 73 is arranged on a container front side (a side in the attachment direction Q) of the container receiving section 72 in the longitudinal direction (attachment/detachment direction). The insertion hole part 71 is arranged on one end side (a side in the detachment direction Q1) of the container receiving section 72 in the longitudinal direction. The four toner containers 32Y, 32M, 32C, and 32K are able to move on the container receiving section 72 in a sliding manner. Therefore, along with the attachment operation of the toner containers, the container covers 34Y, 34M, 34C, and 34K first pass through the insertion hole part 71, slides on the container receiving section 72 for a while, and are finally attached to the container cover receiving section 73.

As illustrated in FIG. 5, while the container cover 34Y is attached to the container cover receiving section 73, the driving part (container rotating part) 91Y including a driving motor, a gear, and the like inputs rotation drive to the container gear 301Y that is a gear arranged in the container body 33Y, via a container driving gear 601Y serving as an apparatus main-body gear. Therefore, the container body 33Y is rotated in the arrow A direction in FIG. 5. With the rotation of the container body 33Y, a spiral rib 302Y formed in a spiral shape on the inner surface of the container body 33Y conveys toner in the container body 33Y from one end on the right side in FIG. 5 to the other end on the left side in FIG. 5 along the longitudinal direction of the container body. Namely, in the embodiment, the spiral rib 302Y serves as a rotary conveyor. Consequently, the toner is supplied to the inside of the conveying nozzle 611Y via a nozzle hole 610Y provided on the conveying nozzle 611Y, and supplied from the other side of the toner container 32Y where the container cover 34Y is attached. The nozzle hole 610 communicates with openings 335*b*, as shutter side openings, of a shutter supporting portion (to be described later), at an inner position relative to the position where the container gear 301 is arranged in the longitudinal direction of the container bodies 33Y. Specifically, the container gear 301 meshes with the container driving gear 601 at the position closer to a container opening 33*a* relative to the position where the nozzle hole 610 and the openings 335*b* of the shutter supporting portion communicate with each other.

The conveying screw 614Y is arranged in the conveying nozzle 611Y. When the driving part (container rotating part) 91Y inputs rotation drive to a conveying screw gear 605Y, the conveying screw 614Y rotates and conveys the toner supplied in the conveying nozzle 611Y. A downstream end of the conveying nozzle 611Y in the conveying direction is connected to the toner dropping passage 64Y. The toner conveyed by the conveying screw 614Y falls along the toner dropping passage 64Y by gravity and is replenished to the developing device 50Y (the second developer accommodating section 54Y).

The toner containers 32Y, 32M, 32C, and 32K are replaced with new ones at the end of their lifetimes (when the containers become empty because almost all of the contained toner is consumed). Grippers 303Y, 303M, 303C, and 303K are arranged on one ends of the toner containers 32Y, 32M, 32C, and 32K opposite to the container covers 34Y, 34M, 34C, and 34K in the longitudinal direction in FIG. 5, that is, on the downstream in the detachment direction Q1. When the toner containers are to be replaced, an operator can grip the grippers 303Y, 303M, 303C, and 303K to pull out and detach the toner containers 32Y, 32M, 32C, and 32K attached to the toner container holder 70.

Figure 6:
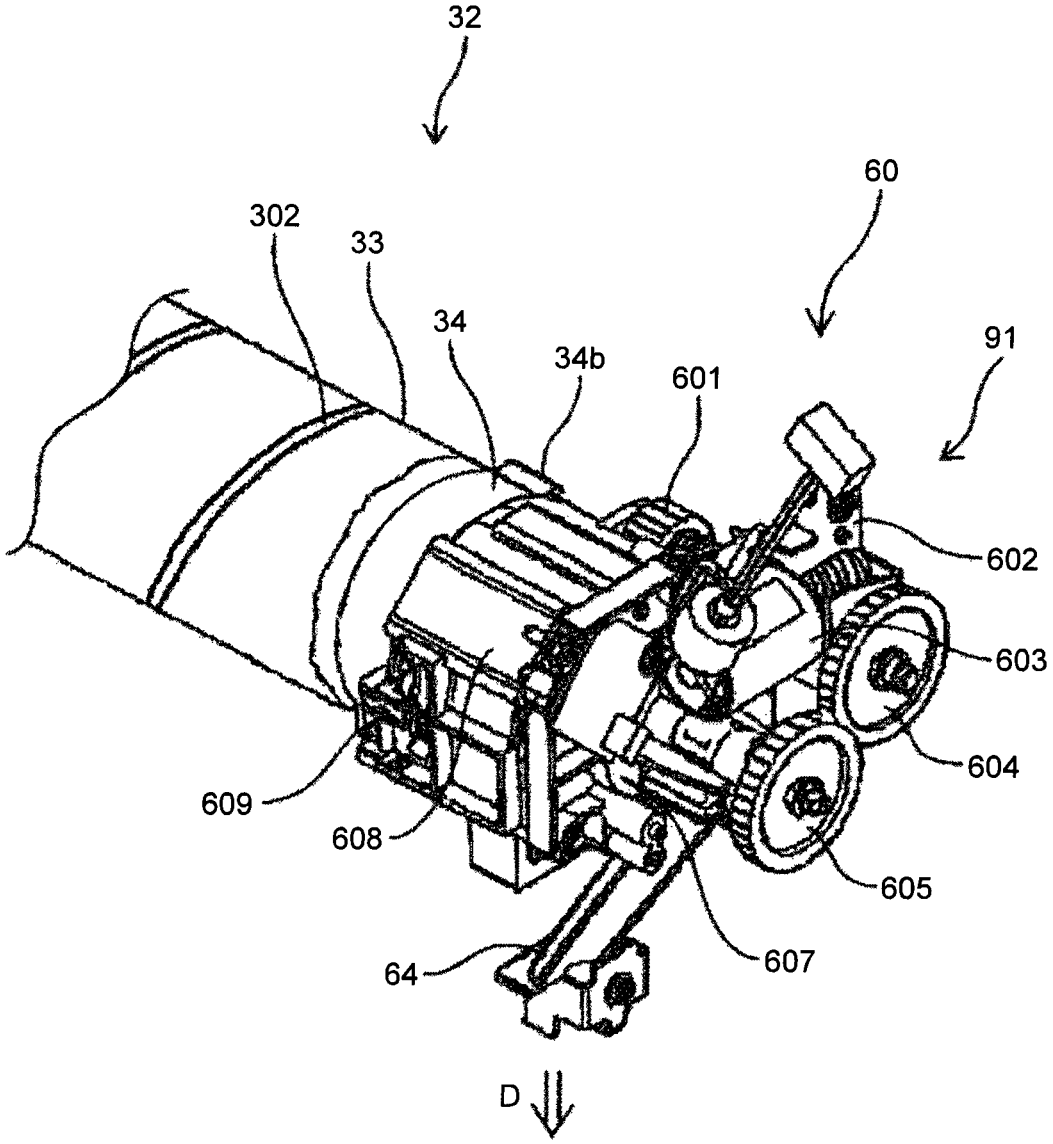
FIG. 6 is an explanatory perspective view of the powder conveying device to which the powder container is attached and the powder container.

The configuration of the driving part 91 will be further described below with reference to FIG. 6. In FIG. 6, symbols representing the colors are omitted. The driving part 91 includes the container driving gear 601 and the conveying screw gear 605. When a driving motor 603 mounted on amounting frame 602 is driven and an output gear of the driving motor 603 is rotated, the container driving gear 601 rotates. The conveying screw gear 605 rotates by receiving the rotation of the output gear via a coupled gear 604.

As illustrated in FIG. 5, the toner replenishing device 60Y controls the amount of toner supplied to the developing device 50Y in accordance with the rotation frequency of the conveying screw 614Y. Therefore, toner that has passed through the conveying nozzle 611Y is directly conveyed to the developing device 50Y through the toner dropping passage 64Y without the need to control the amount of toner supplied to the developing device 50Y. Even in the toner replenishing device 60Y configured to insert the conveying nozzle 611Y in the toner container 32Y as described in the embodiment, it may be possible to arrange a temporary toner storage, such as a toner hopper. In the toner replenishing devices 60M, 60C, and 60K for the other colors, the amount of toner supply is controlled in the same manner as in the toner replenishing device 60Y.

The toner containers 32Y, 32M, 32C, and 32K and the toner replenishing devices 60Y, 60M, 60C, and 60K according to the embodiment will be described in detail below. As described above, the toner containers 32Y, 32M, 32C, and 32K and the toner replenishing devices 60Y, 60M, 60C, and 60K have almost the same configurations except that the colors of toner to be used are different. Therefore, in the following descriptions, symbols Y, M, C, and K representing the colors of toner will be omitted.

Figure 7:
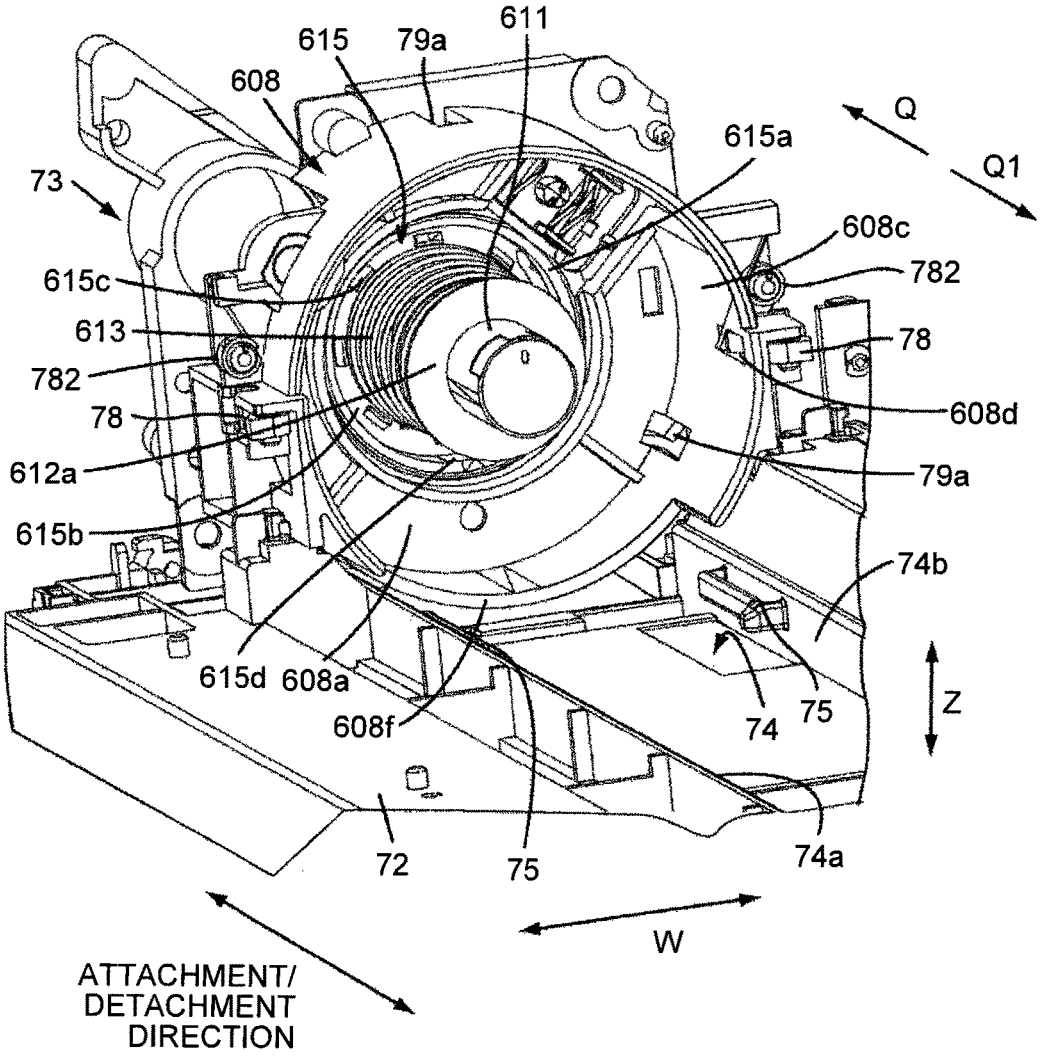
FIG. 7 is an explanatory partially-enlarged perspective view of the container holding section according to each embodiment.
Figure 8:
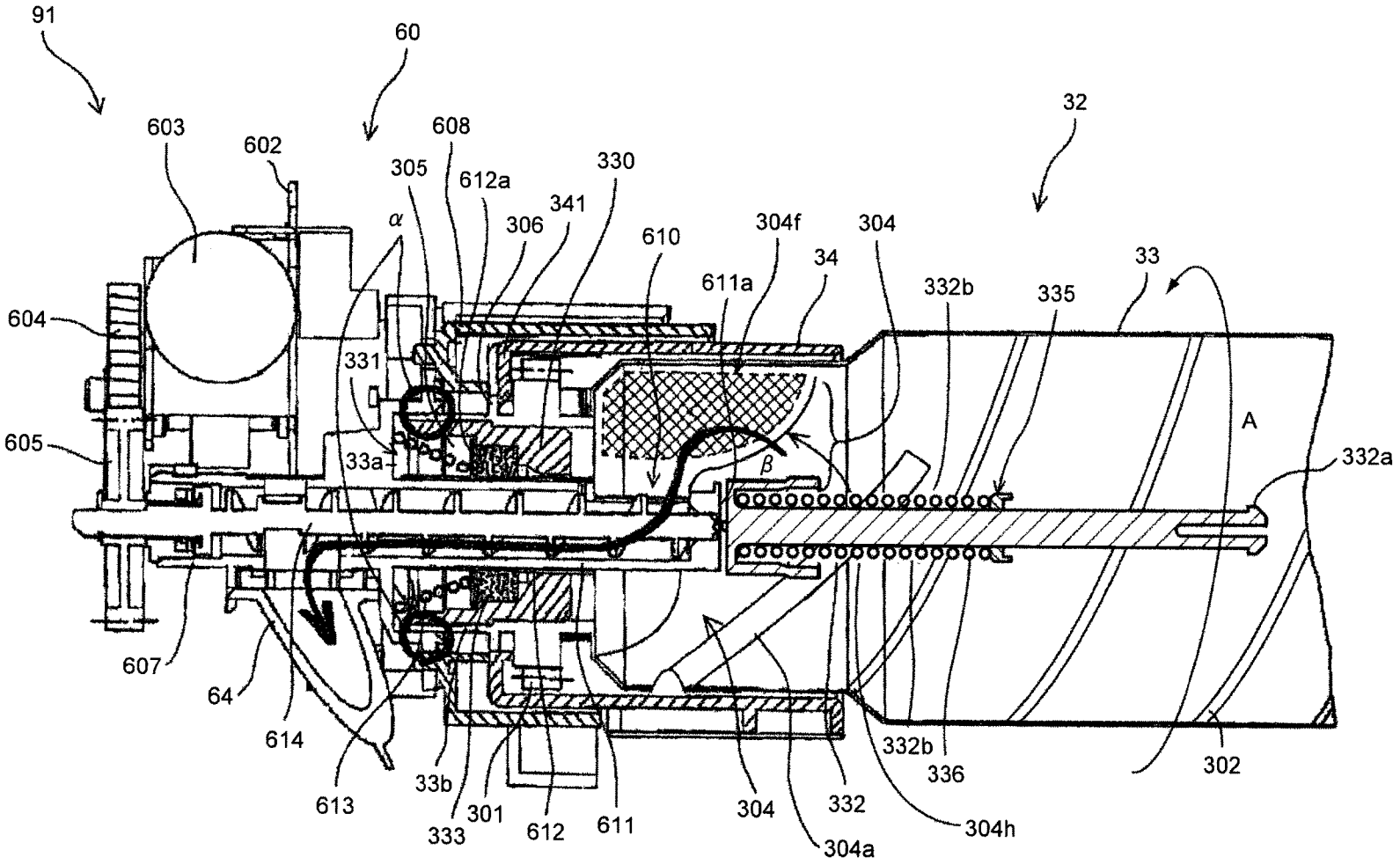
FIG. 8 is an explanatory cross-sectional view of the powder conveying device to which the powder container is attached and the powder container.
Figure 9:
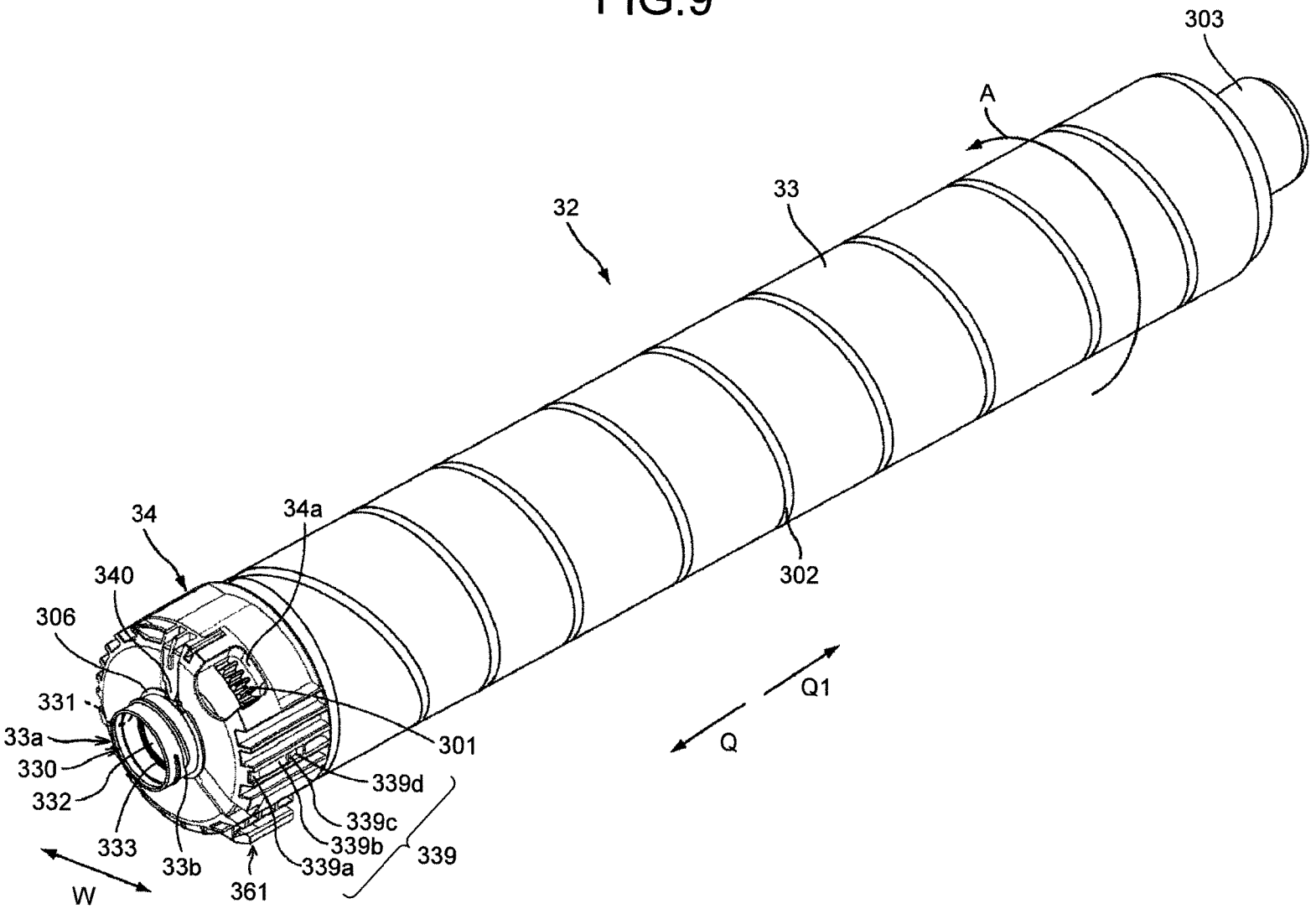
FIG. 9 is an explanatory perspective view illustrating a configuration of the powder container according to the embodiment.

FIG. 1 is an explanatory cross-sectional view of the toner replenishing device 60 before the toner container 32 is attached and a front end of the toner container 32. FIG. 7 is a perspective view illustrating a configuration of the container cover receiving section 73 of the toner container holder 70. FIG. 8 is an explanatory cross-sectional view of the toner replenishing device 60 to which the toner container 32 is attached and the front end of the toner container 32. FIG. 9 is an explanatory perspective view of the toner container 32.

As illustrated in FIGS. 1 and 8, the toner replenishing device 60 includes the conveying nozzle 611 in which the conveying screw 614 is arranged, and a nozzle shutter 612. The nozzle shutter 612 is slidably mounted on the outer surface of the conveying nozzle 611 so as to close the nozzle hole 610 at the time of detachment, which is before the toner container 32 is attached (in the state in FIG. 1), and to open the nozzle hole 610 at the time of attachment, which is when the toner container 32 is attached (in the state in FIG. 8). The nozzle shutter 612 includes a nozzle shutter flange 612*a* serving as a flange on the downstream side in the attachment direction relative to an end surface of a nozzle receiver 330, which serves as a nozzle insertion member (to be described later), in contact with the conveying nozzle 611.

As illustrated in FIG. 8, in the center of the front end of the toner container 32, a receiving opening 331, which serves as a nozzle insertion opening into which the conveying nozzle 611 is inserted at the time of attachment, is arranged, and a container shutter 332, which serves as an opening/closing member that closes the receiving opening 331 at the time of detachment, is arranged.

As illustrated in FIG. 4, the container receiving section 72 arranged on the toner container holder 70 is divided into four sections in a width direction W perpendicular to the longitudinal direction (attachment/detachment direction) of the toner container 32. Gutters 74 serving as container mounting sections as illustrated in FIG. 7 are provided so as to extend from the insertion hole part 71 to the container cover receiving section 73 along the longitudinal direction of the container bodies 33Y, 33M, 33C, and 33K. The toner containers 32 for the respective colors are able to move on the gutters 74 in a sliding manner in the longitudinal direction.

As illustrated in FIG. 7, on side surfaces 74*a* and 74*b* of the gutter 74, which are opposite surfaces arranged in the width direction W, guide rails 75 are arranged so as to face each other. The guide rails 75 protrude in the width direction W from the respective side surfaces 74*a* and 74*b*, extend in the longitudinal direction, and are arranged in front of the container cover receiving section 73. The guide rails 75 have functions to guide the container opening 33*a*, which serves as the opening at the other end of the toner container 32, to a container setting section 615 serving as a container receiving section by being fitted to sliding guides 361 serving as guiding portions on the toner container 32 side illustrated in FIG. 9 when the toner container 32 is attached to the printer 100 (the toner container holder 70 and the toner replenishing device 60). Each of the guide rails 75 is provided so as to be parallel to the rotation axis of the container body 33 when the toner container 32 is attached to the toner replenishing device 60.

Figure 10:
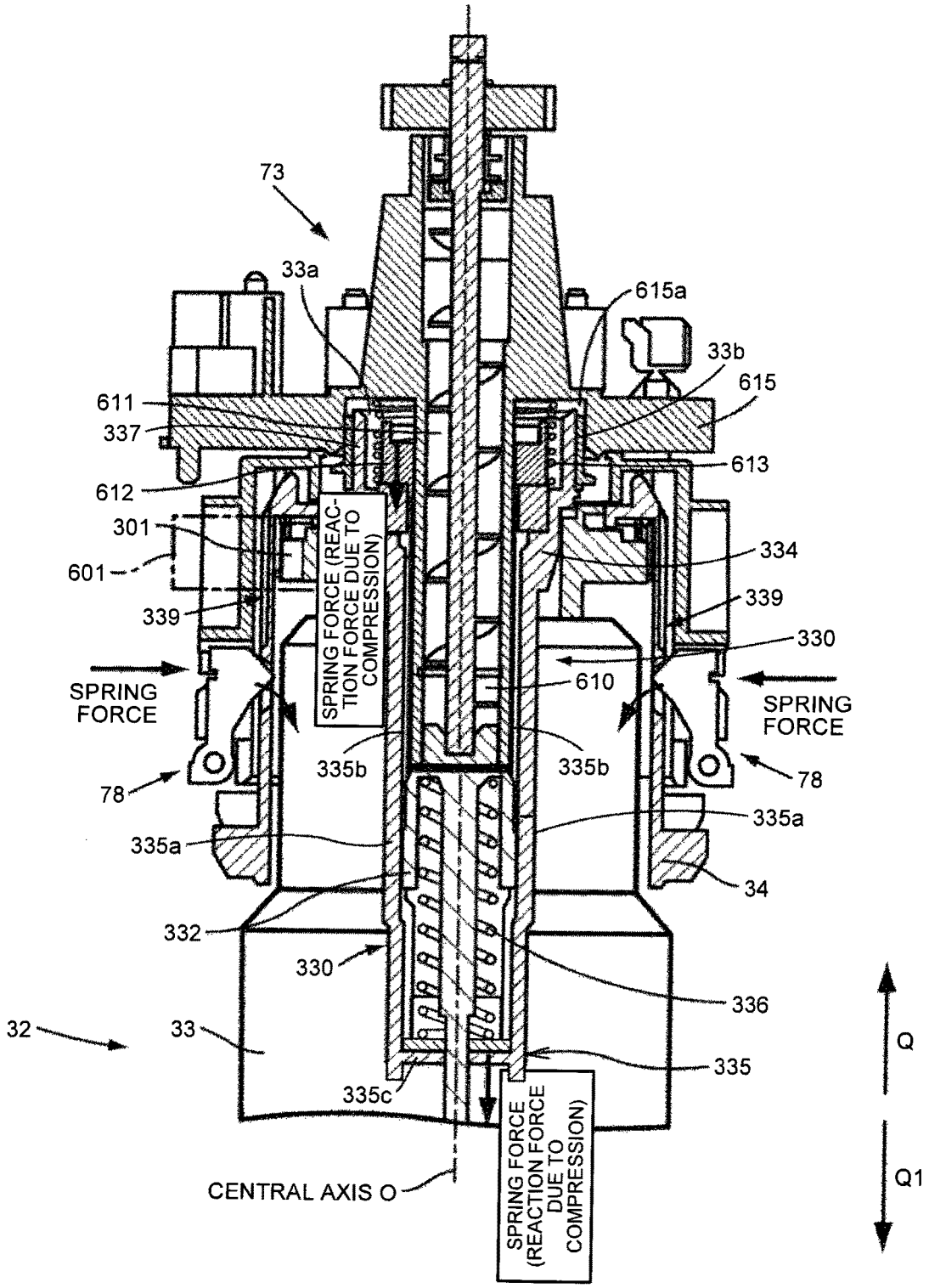
FIG. 10 is an explanatory cross-sectional view of the container holding section to which the powder container is attached.

As illustrated in FIG. 7, the setting cover 608 for each color is arranged on the container cover receiving section 73. The conveying nozzle 611 is arranged in the center of the setting cover 608. The conveying nozzle 611 is arranged so as to protrude from an end surface 615*b*, which is on the inner side in the attachment direction, of the container setting section 615, which is located on the downstream side in the attachment direction of the toner container 32, toward the upstream side in the attachment direction inside the container cover receiving section 73. The container setting section 615 serving as the container receiving section is arranged in a standing manner in the protruding direction of the conveying nozzle 611, that is, toward the upstream side in the attachment direction of the toner container 32 so as to surround the conveying nozzle 611. Specifically, as illustrated in FIG. 10, the container setting section 615 is arranged at the base of the conveying nozzle 611, and serves as a positioner to determine the position of the container opening 33*a* relative to the toner container holder 70, where the container opening 33*a* functions as a rotational axis when the rotary conveyor inside the toner container 32 rotates to convey the toner contained in the toner container 32. Namely, when the container opening 33*a* is inserted in and mated to the container setting section 615, the radial position of the container opening 33*a* is determined.

When the toner container 32 is attached to the toner replenishing device 60, an outer surface 33*b* of the container opening 33*a* of the toner container 32 is slidably mated to the container setting section 615. As illustrated in FIG. 7, on an inner surface 615*a* of the container setting section 615, contact surfaces 615*d*, which are parts of the inner surface 615*a* and which protrude inward in the radial direction from the inner surface 615*a*, are provided at four evenly-spaced positions. The contact surfaces 615*d* and the outer surface 33*b* slide against each other along with rotation of the toner container 32.

By the mating of the inner surface 615*a* of the container setting section 615 and the outer surface 33*b* of the container opening 33*a* of the toner container 32, the position of the toner container 32 relative to the toner replenishing device 60 in the radial direction perpendicular to the longitudinal direction (attachment/detachment direction) of the toner container 32 is determined. Further, when the toner container 32 rotates, the outer surface 33*b* of the container opening 33*a* functions as a rotational shaft, and the inner surface 615*a* of the container setting section 615 functions as a bearing. In FIG. 8, a indicates the position at which the outer surface 33*b* of the container opening 33*a* comes in sliding contact with the contact surfaces 615*d* as the parts of the inner surface 615*a* of the container setting section 615 and at which the radial position of the toner container 32 relative to the toner replenishing device 60 is determined at this time.

In the descriptions below, it is repeatedly explained that the outer surface 33*b* of the container opening 33*a* of the toner container 32 and the container setting section 615 mate with each other in a slidable manner. The mating state is, in a precise sense, a state in which the outer surface 33*b* of the container opening 33*a* of the toner container 32 is in contact with the contact surfaces 615*d* provided on the inner surface 615*a* of the container setting section 615. Hereinafter, for simplicity of explanation, the mating will be referred to as mating the outer surface 33*b* of the container opening 33*a* with the inner surface 615*a* of the container setting section 615 by omitting the contact surfaces 615*d*.

As illustrated in FIG. 7, holes 608*d* are provided so as to face each other in the width direction W of the setting cover 608. On the setting cover 608, replenishing device engaging members 78 (to be described later) are arranged so as to be able to move back and forth from the outer surface to an inner surface 608*c* side of the setting cover 608 via the holes 608*d*. The replenishing device engaging members 78 are biased from the outer side to the inner side of the setting cover 608 by biasing means, such as torsion coil springs 782.

The toner container 32 will be described below. As illustrated in FIG. 9, the toner container 32 mainly includes the container body 33 containing toner, and includes the container cover 34. The container body 33 is in the form of an approximate cylinder and rotates about a central axis of the cylinder as a rotation axis. Hereinafter, one side of the toner container 32 where the receiving opening 331 is provided (the side where the container cover 34 is arranged) in the longitudinal direction of the toner container 32 may be referred to as "a container front end". The other side of the toner container 32 where the gripper 303 is arranged (the side opposite the container front end) may be referred to as "a container rear end". The longitudinal direction of the toner container 32 is the rotation axis direction, and corresponds to the horizontal direction when the toner container 32 is attached to the toner replenishing device 60. The container rear end of the container body 33 relative to the container gear 301 has a greater outer diameter than that of the container front end. The spiral rib 302 is provided on the inner surface of the container body 33. When the container body 33 rotates in the arrow A direction in the figures, a conveying force for moving toner from one end (the container rear end) to the other end (the container front end) in the rotation axis direction is applied to the toner in the container body 33 due to the action of the spiral rib 302.

As illustrated in FIG. 8, a scooping portion 304, which scoops up the toner conveyed to the container front end by the spiral rib 302 along with the rotation of the container body 33 in the arrow A direction in the figures, is provided on the inner wall of the container front end of the container body 33. The scooping portion 304 scoops up toner, which has been conveyed by the conveying force of the spiral rib 302, by using a scooping wall surface 304*f* along with the rotation of the container body 33. Therefore, the toner can be scooped up so as to be located above the inserted conveying nozzle 611. As illustrated in FIGS. 1 and 8, a spiral rib 304*a* at the scooping portion is also provided on the inner surface of the scooping portion 304, similarly to the spiral rib 302. The spiral rib 304*a* at the scooping portion has a spiral shape and serves as a conveying portion to convey internally-located toner.

As illustrated in FIG. 9, the container gear 301 is provided on the container front end relative to the scooping portion 304 of the container body 33. A gear exposing opening 34*a* is arranged on the container cover 34 so that a part of the container gear 301 is exposed when the container cover 34 is attached to the container body 33. When the toner container 32 is attached to the toner replenishing device 60, the container gear 301 exposed from the gear exposing opening 34*a* meshes with the container driving gear 601 of the toner replenishing device 60. The container gear 301 is arranged near the container opening 33*a* (near the container opening 33*a*) relative to the nozzle hole 610 in the longitudinal direction of the container body 33 so as to be able to mesh with the container driving gear 601. The container gear 301 meshes with the container driving gear 601, thereby enabling the rotary conveyor to rotate.

The container opening 33*a* in the form of a cylinder is provided on the container front end relative to the container gear 301 of the container body 33 so as to be coaxial with the container gear 301. As illustrated in FIGS. 1 and 8, a nozzle receiver attachment portion 337, as a wall, of the nozzle receiver 330 is attached to the container opening 33*a* so as to be coaxial with the container opening 33*a* by using an engagement system to be described later, and therefore, the nozzle receiver 330 can be detachably attached to the container body 33. The toner container 32 is configured such that toner is replenished from the container opening 33*a* serving as an opening provided on one end of the container body 33, and thereafter, the nozzle receiver 330 is inserted in and attached to the container opening 33*a* of the container body 33.

As illustrated in FIG. 9, a cover hook stopper 306 serving as a restrictor is provided between the container opening 33*a* of the container body 33 and the container gear 301. The cover hook stopper 306 has a ring shape extending in the rotation direction (circumferential direction) on the front end of the container cover 34 in the attachment direction.

The container cover 34 is attached to the toner container 32 (the container body 33) from the container front end (from the bottom left side in FIG. 8). Therefore, the container body 33 penetrates through the container cover 34 in the longitudinal direction, and a cover hook 341 as a protrusion is engaged with the cover hook stopper 306 serving as the restrictor. The container body 33 and the container cover 34 are attached so as to rotate relative to each other when the cover hook 341 is engaged with the cover hook stopper 306. The cover hook 341 is made of a resin material.

As illustrated in FIG. 9, on the container cover 34 of the toner container 32, the sliding guides 361 serving as guiding portions are provided on lower portions in the width direction W. The sliding guides 361 restrict the toner container 32 being attached from moving in directions other than the attachment direction, to thereby guide the container opening 33*a* to the container setting section 615 when the toner container 32 is attached to the printer 100. In FIG. 9, only one of the sliding guides 361 is illustrated. Each of the sliding guides 361 includes a gutter extending in the longitudinal direction of the container body 33. The sliding guides 361 are configured such that the guide rails 75, as a pair, provided on the gutters 74 of the container receiving section 72 as illustrated in FIG. 7 are inserted in the respective gutters and sandwiched in the vertical direction. Therefore, the sliding guides 361 function as positioners of the container cover 34 in the width direction W perpendicular to a vertical direction Z and the detachment direction Q1 when the toner container 32 is attached to the printer 100 (the toner replenishing device 60 and the toner container holder 70).

As illustrated in FIG. 9, container engaging portions 339 are provided on the surface of the container cover 34 in the width direction W to determine the position of the toner container 32 relative to the toner replenishing device 60 in the longitudinal direction (attachment/detachment direction). In FIG. 9, only one of the container engaging portions 339 is illustrated. When the toner container 32 is attached to the toner replenishing device 60, the replenishing device engaging members 78 (see FIGS. 7 and 10) arranged on the setting cover 608 are engaged with the container engaging portions 339.

As illustrated in FIG. 9, each of the container engaging portions 339 includes a guiding protrusion 339*a*, a guiding groove 339*b*, a bump 339*c*, and an engaging opening 339*d* serving as an axial restrictor. A pair of the container engaging portions 339 is arranged so as to be located on left and right sides of the container cover 34. Namely, the engaging openings 339*d* are arranged on the left and right sides across the center of the container opening 33*a*. Each of the guiding protrusions 339*a* is provided on the container front end of the container cover 34 and located on a vertical plane perpendicular to the longitudinal direction of the toner container 32 and on a horizontal plane passing through the rotation axis of the container body 33. Each of the guiding protrusions 339*a* includes an inclined surface adjoined to each of the guiding grooves 339*b* so as to come in contact with the replenishing device engaging members 78 and to guide the replenishing device engaging members 78 to the guiding grooves 339*b* when the toner container 32 is attached. The guiding grooves 339*b* are grooves recessed from the side surface of the container cover 34. A bump 339*c* is provided between each of the guiding grooves 339*b* and each of quadrangular engaging openings 339*d*. The replenishing device engaging members 78 pass over the bumps 339*c* and fall in the engaging openings 339*d*, so that the toner container 32 and the toner replenishing device 60 are engaged with each other. This state is the set position (set state) of the toner container 32 as illustrated in FIGS. 8 and 10.

As illustrated in FIG. 10, the driving part (container rotating part) 91 inputs a rotation driving force to the container gear 301 of the toner container 32 via the container driving gear 601. When the rotation driving force is input to the container gear 301, the outer surface 33*b* of the container opening 33*a* of the container body 33 functions as a rotational shaft and the inner surface 615*a* of the container setting section 615 functions as a bearing. Consequently, the container body 33, in which the container gear 301 is attached or integrated, rotates. In the embodiment, the rotation center of the container gear 301 is located so as to be concentric with the axis of the container opening 33*a*.

In the state in which the toner container 32 is held by the toner container holder 70 (the set state), the outer surface 33*b* of the container opening 33*a* serving as the container front end of the toner container 32 serves as the rotational shaft and is supported by the inner surface 615*a* of the container setting section 615 in the toner container 32, and the engaging openings 339*d* of the container engaging portions 339 are engaged with the replenishing device engaging members 78. The container gear 301 is arranged between the container engaging portions 339 and the container opening 33*a*.

Figure 11:
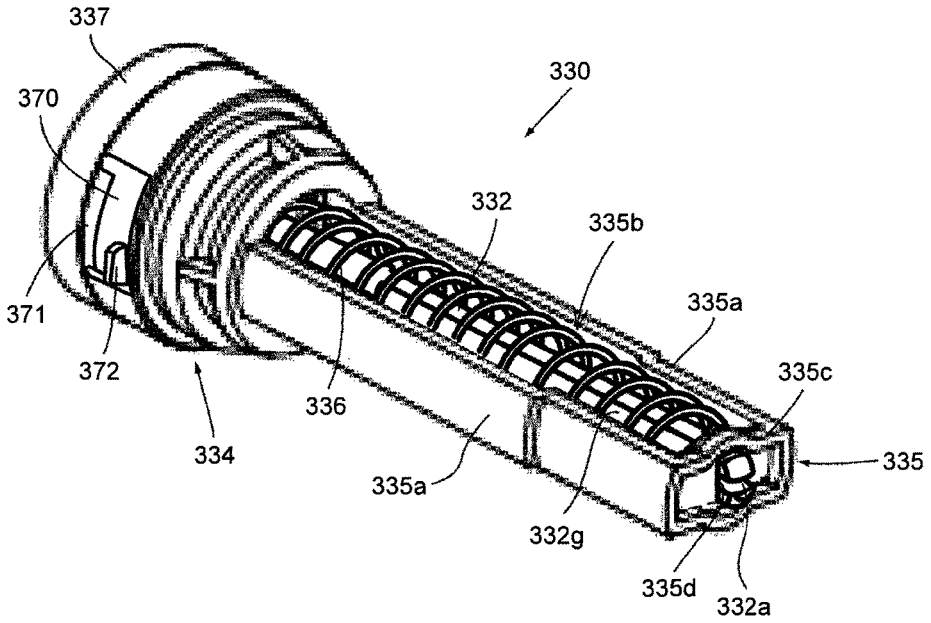
FIG. 11 is an explanatory perspective view of a nozzle receiver (nozzle insertion member) when viewed from a container inner side.
Figure 12:
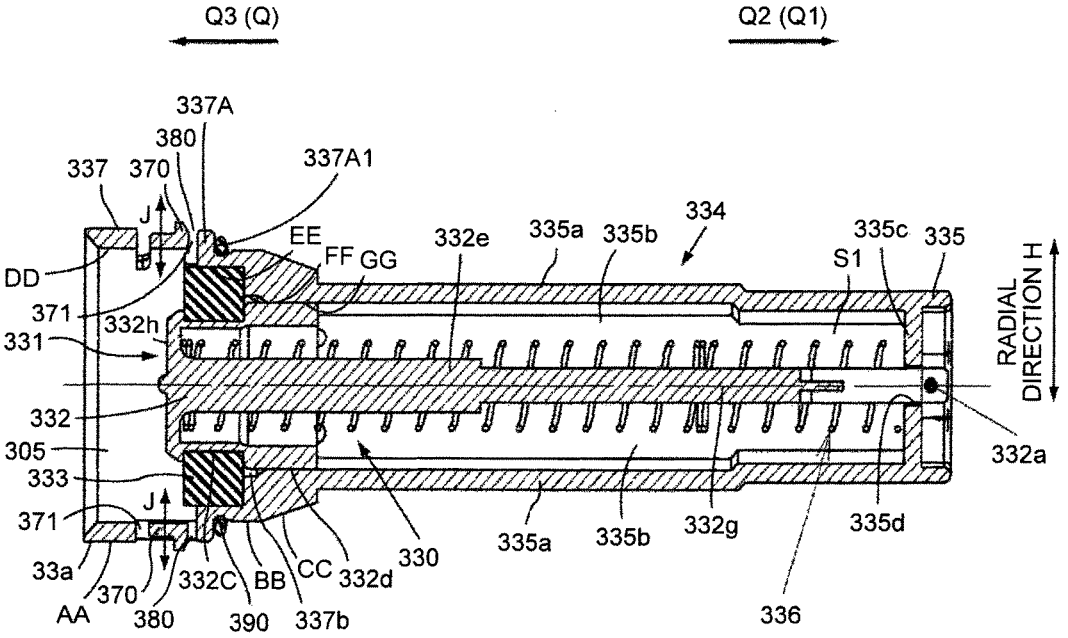
FIG. 12 is a cross-sectional view for explaining a configuration of the nozzle receiver.

The nozzle receiver 330 detachably attached to the container body 33 will be described below. As illustrated in FIGS. 11 to 13, the nozzle receiver 330 is arranged on the toner container 32, and includes the receiving opening 331 serving as a nozzle insertion opening. The conveying nozzle 611 for conveying toner supplied from the toner container 32 in the image forming apparatus is inserted in the receiving opening 331. The nozzle receiver 330 further includes the container shutter 332 serving as an opening/closing member, a container seal 333 serving as a seal, a container shutter supporter 334 serving as a supporter, a container shutter spring 336 serving as a biasing member, and the nozzle receiver attachment portion 337. The container shutter 332 is inserted in and supported by the container shutter supporter 334 in a reciprocating manner so as to move to the opening position to open the receiving opening 331 by being pressed with insertion of the conveying nozzle 611, and to move a closing position to close the receiving opening 331 with removal of the conveying nozzle 611. Namely, the container shutter supporter 334 supports the container shutter 332 to guide the movement to the opening position and the closing position. The container shutter spring 336 is a coil spring that is arranged inside the container shutter supporter 334 and biases the container shutter 332 toward the closing position.

The container shutter supporter 334 includes a shutter rear end supporting portion 335 as a shutter rear portion, a pair of shutter side supporting portions 335*a* as side portions, the openings 335*b* of the shutter supporting portion as shutter side openings, and the nozzle receiver attachment portion 337. The shutter side supporting portions 335*a* are arranged so as to face each other, and extend along the moving direction of the container shutter 332. One ends of the shutter side supporting portions 335*a* are connected by the shutter rear end supporting portion 335, and the other ends are connected to the cylindrical nozzle receiver attachment portion 337. The shutter side supporting portions 335*a* and the openings 335*b* are arranged adjacent to each other in the rotation direction of the toner container. Namely, the container shutter supporter 334 has a shape in which cylindrical portions corresponding to the shutter side supporting portions 335*a* from the nozzle receiver attachment portion 337 side to the shutter rear end supporting portion 335 are vertically cut out along the moving direction of the container shutter 332, and the openings 335*b* are provided in the cutout portions. The container shutter supporter 334 is configured such that the container shutter 332 can move along the insertion direction of the conveying nozzle 611 in a space S1. The space S1 is enclosed by the pair of the shutter side supporting portions 335*a*, the shutter rear end supporting portion 335, and the nozzle receiver attachment portion 337. In other words, the container shutter supporter 334 is configured to be able to guide the movement of the container shutter 332 to the opening position to open the receiving opening 331 and the closing position to close the receiving opening 331.

Figure 13A:
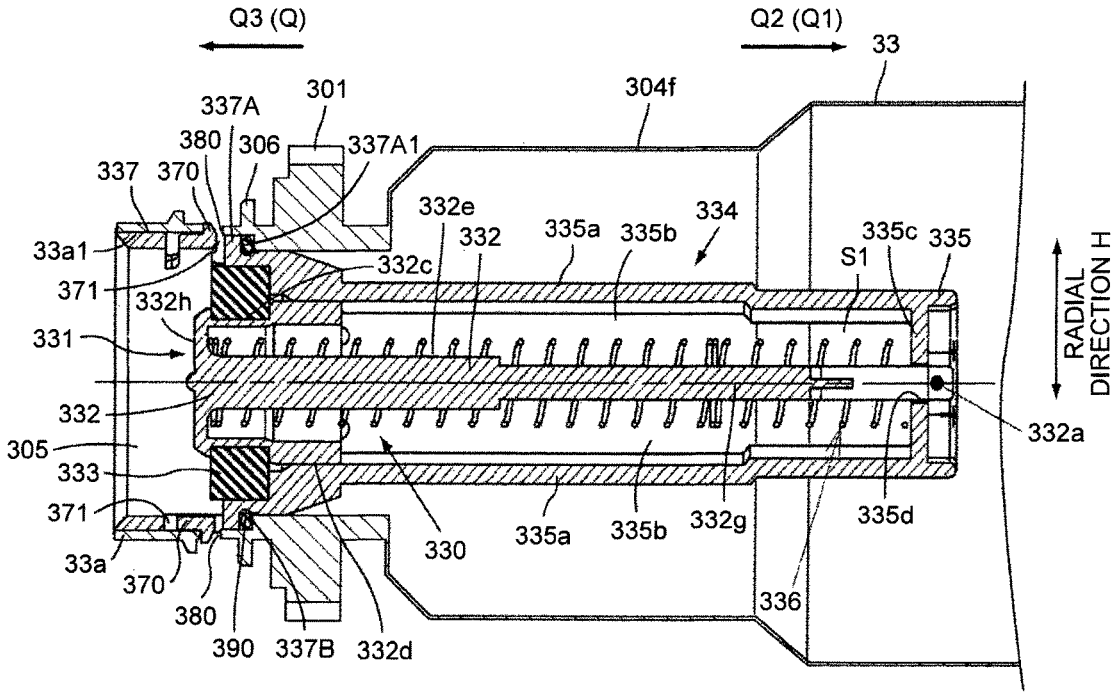
FIG. 13A is a diagram illustrating a state in which a powder storage and the nozzle receiver are attached to each other.
Figure 13B:
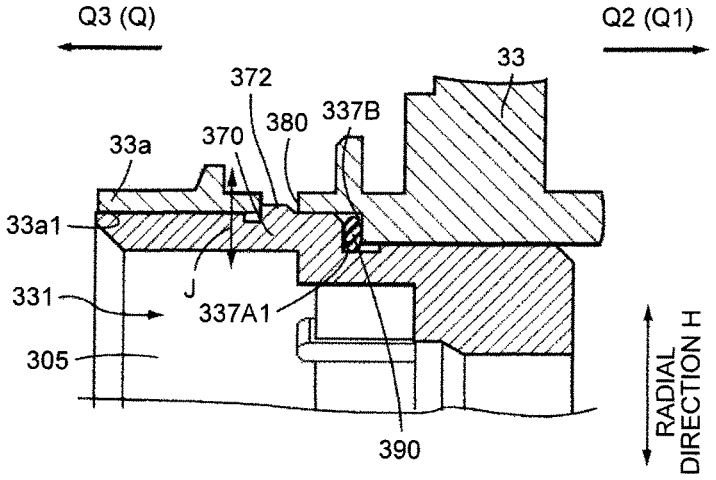
FIG. 13B is an enlarged view of an attaching portion of the powder storage and the nozzle receiver.

As illustrated in FIGS. 13A and 13B, the nozzle receiver 330 attached to the container body 33 rotates with the container body 33 when the container body 33 rotates. At this time, the shutter side supporting portions 335*a* of the nozzle receiver 330 rotate around the conveying nozzle 611 of the toner replenishing device 60 as illustrated in FIG. 10. Therefore, the shutter side supporting portions 335*a* being rotated alternately pass a space just above the nozzle hole 610 provided in the upper side of the conveying nozzle 611. Consequently, even if toner is instantaneously accumulated above the nozzle hole 610, because the shutter side supporting portions 335*a* cross the accumulated toner and alleviate the accumulation, it becomes possible to prevent cohesion of the accumulated toner when the apparatus is not used and prevent a toner conveying failure when the apparatus is resumed. In contrast, when the shutter side supporting portions 335*a* are located on the sides of the conveying nozzle 611 and when the nozzle hole 610 and the openings 335*b* of shutter supporting portion face each other, toner in the container body 33 is supplied to the conveying nozzle 611 as indicated by an arrow β in FIG. 8.

As illustrated in FIG. 12, the container shutter 332 includes a front cylindrical portion 332*c* serving as a closure, a slide area 332*d*, a guiding rod 332*e* serving as an elongated portion, and shutter hooks 332*a* serving as engaged portions. The front cylindrical portion 332*c* is a container front end portion to be tightly fitted to a cylindrical opening (the receiving opening 331) of the container seal 333. The slide area 332*d* is a cylindrical portion serving as a gliding portion or a sealing portion, and is provided on the container rear end relative to the front cylindrical portion 332*c*. The slide area 332*d* has an outer diameter slightly greater than that of the front cylindrical portion 332*c*, slides on the inner surfaces of the pair of the shutter side supporting portions 335*a*, and seals the receiving opening 331.

The guiding rod 332*e* is a cylinder that stands from the inner side of the cylinder of the front cylindrical portion 332*c* toward the container rear end. The guiding rod 332*e* serves as a rod portion that prevents the container shutter spring 336 from being buckled when the guiding rod 332*e* is inserted to the inside of the coil of the container shutter spring 336. A guiding rod sliding portion 332*g* includes a pair of flat surfaces that are provided on both sides across the central axis of the cylindrical guiding rod 332*e* from the middle of the guiding rod 332*e*. The container rear end of the guiding rod sliding portion 332*g* is bifurcated into a pair of cantilevers as illustrated in FIG. 11. The shutter hooks 332*a* are provided on ends of the cantilevers opposite to the base from which the guiding rod 332*e* stands. The shutter hooks 332*a* and the guiding rod sliding portions 332*g* are inserted in a rear end opening 335*d* provided on the shutter rear end supporting portion 335, and the shutter hooks 332*a* are hooked on the rear end opening 335*d*. Therefore, the shutter hooks 332*a* and the guiding rod sliding portion 332*g* serve as a pair of hooks that prevent the container shutter 332 from coming off from the container shutter supporter 334.

As illustrated in FIG. 12, a front end of the container shutter spring 336 abuts an inner wall surface of the front cylindrical portion 332*c*, and a rear end of the container shutter spring 336 abuts an inner wall surface 335*ca* that is an opposite surface of the shutter rear end supporting portion 335. At this time, the container shutter spring 336 is in a compressed state. Therefore, the container shutter 332 receives a biasing force in a direction away from the shutter rear end supporting portion 335 (to the right or toward the container front end in FIG. 22). However, the shutter hooks 332*a* provided on the container rear end of the container shutter 332 are hooked on the rear end opening 335*d* of the shutter rear end supporting portion 335. Therefore, the container shutter 332 is prevented from moving further in the direction away from the shutter rear end supporting portion 335 in the state illustrated in FIG. 12.

Due to the hooked state between the shutter hooks 332*a* and the shutter rear end supporting portion 335 and the biasing force of the container shutter spring 336, the position of the container shutter 332 is determined. Specifically, the positions of the front cylindrical portion 332*c* and the container seal 333 in the axial direction, both of which have a toner leakage preventing function of the container shutter 332, are determined relative to the container shutter supporter 334. Therefore, the positions of the front cylindrical portion 332*c* and the container seal 333 are determined such that they can be fitted to each other, so that it becomes possible to prevent toner leakage.

As illustrated in FIG. 12, the nozzle receiver attachment portion 337 is in the form of a cylinder, the outer diameter and the inner diameter of which are reduced in a stepped manner toward the container rear end. The diameters are gradually reduced from the container front end to the container rear end. As illustrated in FIG. 12, three outer diameter portions (outer surfaces AA, BB, and CC in this order from the container front end) are provided on the outer surface, and four inner diameter portions (inner surfaces DD, EE, FF, and GG in this order from the container front end) are provided on the inner surface. A step portion 337A is provided at the boundary of the outer surface AA and the outer surface BB. The diameter of the step portion 337A is greater than the diameter of the outer surface BB and smaller than the diameter of the outer surface AA. A surface of the step portion 337A on the outer surface BB side functions as a contact surface 337A1 serving as a seal receiving surface. Specifically, the contact surface 337A1 is arranged so as to face a contact surface 337B provided on the container body 33 when the nozzle receiver 330 is attached inside the container opening 33*a* of the container body 33. The contact surface 337B serves as a seal receiving surface. An elastic O ring 390, which serves as a seal member and is made of rubber or resin, is sandwiched between the contact surface 337A1 and the contact surface 337B to seal a space between the container opening of the container body 33 and the nozzle receiver 330. The O ring 390 is a seal member interposed between the nozzle receiver 330 attached inside the container opening 33*a* and an inner surface 33*a*1 of the container opening 33*a*. The O ring 390 is arranged on the container inner side relative to an engaging position of an engaging portion and an engaged portion to be described later. The diameter of the inner surface EE is smaller than the diameter of the inner surface DD, and is approximately the same as the diameter of the ring-shaped container seal 333. The container seal 333 is provided between the inner surface EE and the slide area 332*d*. The inner diameter portion FF forms a seal jam preventing space 337*b*. The inner diameter portion GG is provided as a cylindrical inner surface and has a diameter approximately the same as the diameter of the slide area 332*d* of the container shutter 332. The inner diameter portion GG supports the slide area 332*d* such that the slide area 332*d* can slide.

As illustrated in FIG. 12, the pair of the shutter side supporting portions 335*a* protrudes from the nozzle receiver attachment portion 337. The shutter side supporting portions 335*a* face each other and have flake shapes obtained by cutting a cylinder in the axial direction. The ends of the two shutter side supporting portions 335*a* on the container rear side are connected by the shutter rear end supporting portion 335.

As illustrated in FIG. 8, when the toner container 32 is attached to the toner replenishing device 60, the nozzle shutter flange 612*a* of the nozzle shutter 612 of the toner replenishing device 60 presses and deforms the protruding portion of the container seal 333 by being biased by a nozzle shutter spring 613. The nozzle shutter flange 612*a* further moves inward and abuts the container front ends of nozzle shutter positioning ribs 337*a*, thereby covering and sealing the front end surface of the container seal 333 from the outside of the container. Therefore, it becomes possible to ensure the sealing performance in the periphery of the conveying nozzle 611 at the receiving opening 331 in the attached state, enabling to prevent toner leakage.

Figure 14A:
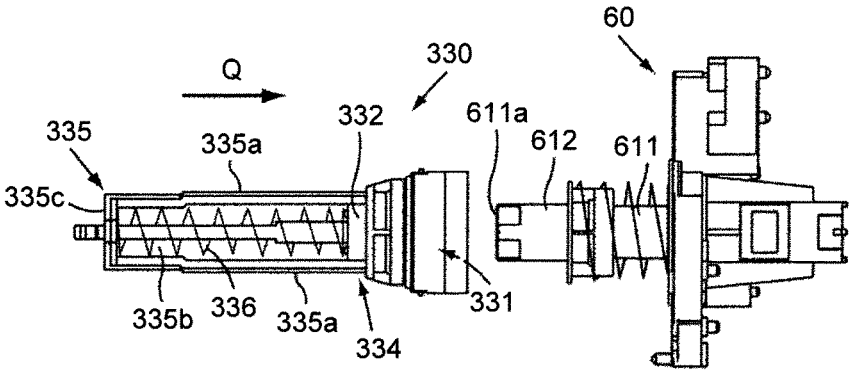
FIGS. 14A to 14D are plan views for explaining a state in which an opening/closing member and a conveying nozzle are attached to each other when viewed from above.
Figure 14B:
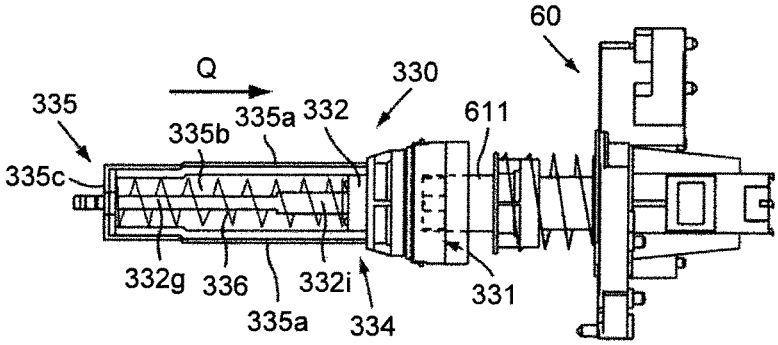
Figure 14C:
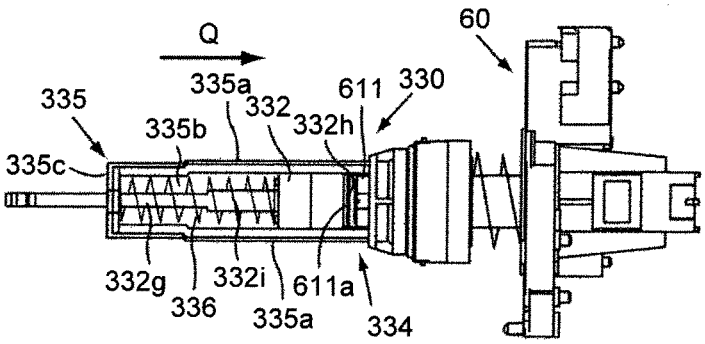
Figure 14D:
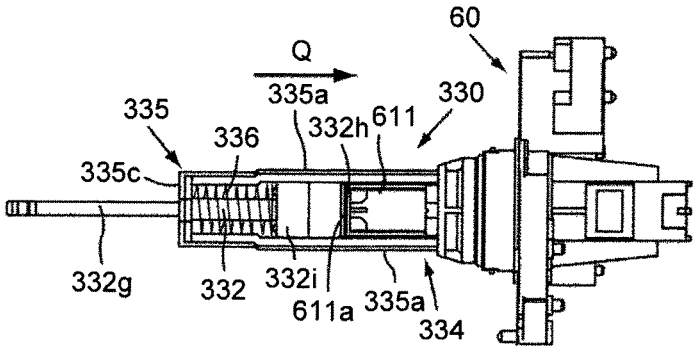

The operation of the container shutter 332 and the conveying nozzle 611 will be described below with reference to FIGS. 1, 8, and 14A to 14D. Before the toner container 32 is attached to the toner replenishing device 60, as illustrated in FIG. 1, the container shutter 332 is biased by the container shutter spring 336 toward the closing position so as to close the receiving opening 331. The appearance of the container shutter 332 and the conveying nozzle 611 at this time is illustrated in FIG. 14A. When the toner container 32 is attached to the toner replenishing device 60, the conveying nozzle 611 is inserted in the receiving opening 331 as illustrated in FIG. 14B. When the toner container 32 is further pushed into the toner replenishing device 60, an end surface 332*h* of the front cylindrical portion 332*c*, which serves as an end surface of the container shutter 332 (hereinafter, referred to as "the end surface 332*h* of the container shutter") and an end surface 611*a* located in the insertion direction of the conveying nozzle 611 (hereinafter, referred to as "the front end (end surface) 611*a* of the conveying nozzle") come in contact with each other. When the toner container 32 is further pushed from the state as described above, the container shutter 332 is pushed as illustrated in FIG. 14C. Consequently, as illustrated in FIG. 14D, the conveying nozzle 611 is inserted in the shutter rear end supporting portion 335 from the receiving opening 331. Therefore, as illustrated in FIG. 8, the conveying nozzle 611 is inserted in the container body 33 and located at the set position. At this time, as illustrated in FIG. 14D, the nozzle hole 610 is located at a position overlapping the openings 335*b* of the shutter supporting portion.

Subsequently, when the container body 33 rotates, toner scooped up above the conveying nozzle 611 by the scooping portion 304 falls in and is introduced into the conveying nozzle 611 via the nozzle hole 610. The toner introduced into the conveying nozzle 611 is conveyed inside the conveying nozzle 611 toward the toner dropping passage 64 along with the rotation of the conveying screw 614. Then, the toner falls in and is supplied to the developing device 50 through the toner dropping passage 64.

A configuration of an attaching portion of the nozzle receiver 330 and the container body 33 will be described in detail below.

After the toner in the toner container 32 is used up, the toner container 32 is collected as a used toner container, and is replenished with toner again by recycling. To replenish toner again, it is necessary to temporarily detach the nozzle receiver 330 provided with the container shutter 332 from the container body 33, replenish toner to the container body 33, and attach the nozzle receiver 330 to the container body 33 again. However, in a conventional configuration, the nozzle receiver 330 is press fitted to the container opening 33*a* of the container body 33. Therefore, when the nozzle receiver 330 is detached from the container body 33, the nozzle receiver 330 and the container body 33 are stressed, and parts may be deformed or damaged or the nozzle receiver 330 may not be detached. Even if the nozzle receiver 330 is detached, in some cases, it may be difficult to attach the nozzle receiver 330 again and the nozzle receiver 330 needs to be replaced with a new one.

As a method of attaching the nozzle receiver 330 and the container body 33, fastening using a fastening member, such as a screw, may be employed instead of press fitting. In this case, the nozzle receiver 330 may be detached and separated from the container body 33 by loosening the fastening member at the time of recycling. However, the container opening 33*a* that serves as an attaching portion of the nozzle receiver 330 of the container body 33 is thin. Therefore, it is extremely difficult to form a screw hole in the container opening 33*a*. Further, depending on a fastening position, the O ring 390 that seals a gap between the nozzle receiver 330 and the container opening, 33*a* of the container body 33 may be twisted when the nozzle receiver 330 fastened with a screw. In this case, it may be difficult to fulfill the function of the O ring 390.

Figure 15A:
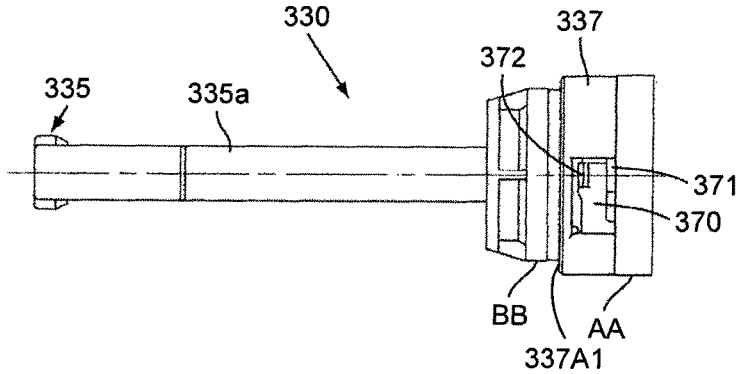
FIG. 15A is a side view of the nozzle receiver from which the opening/closing member is removed.
Figure 15B:
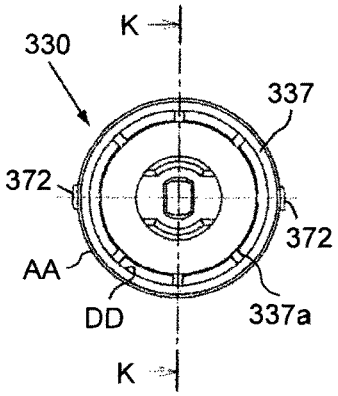
FIG. 15B is a front view of the nozzle receiver in FIG. 15A when viewed in an axial direction.
Figure 15C:
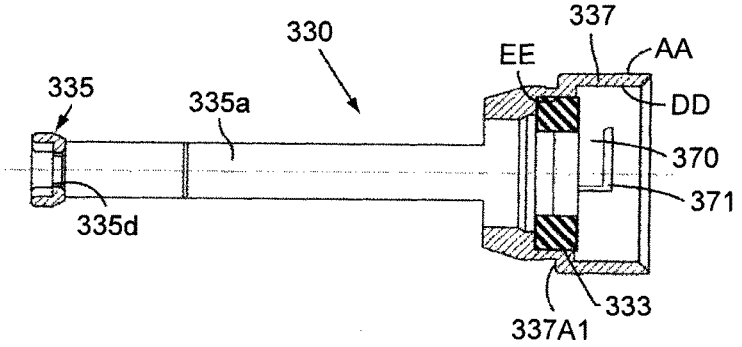
FIG. 15C is a cross-sectional view taken along a line K-K in FIG. 15B.
Figure 16:
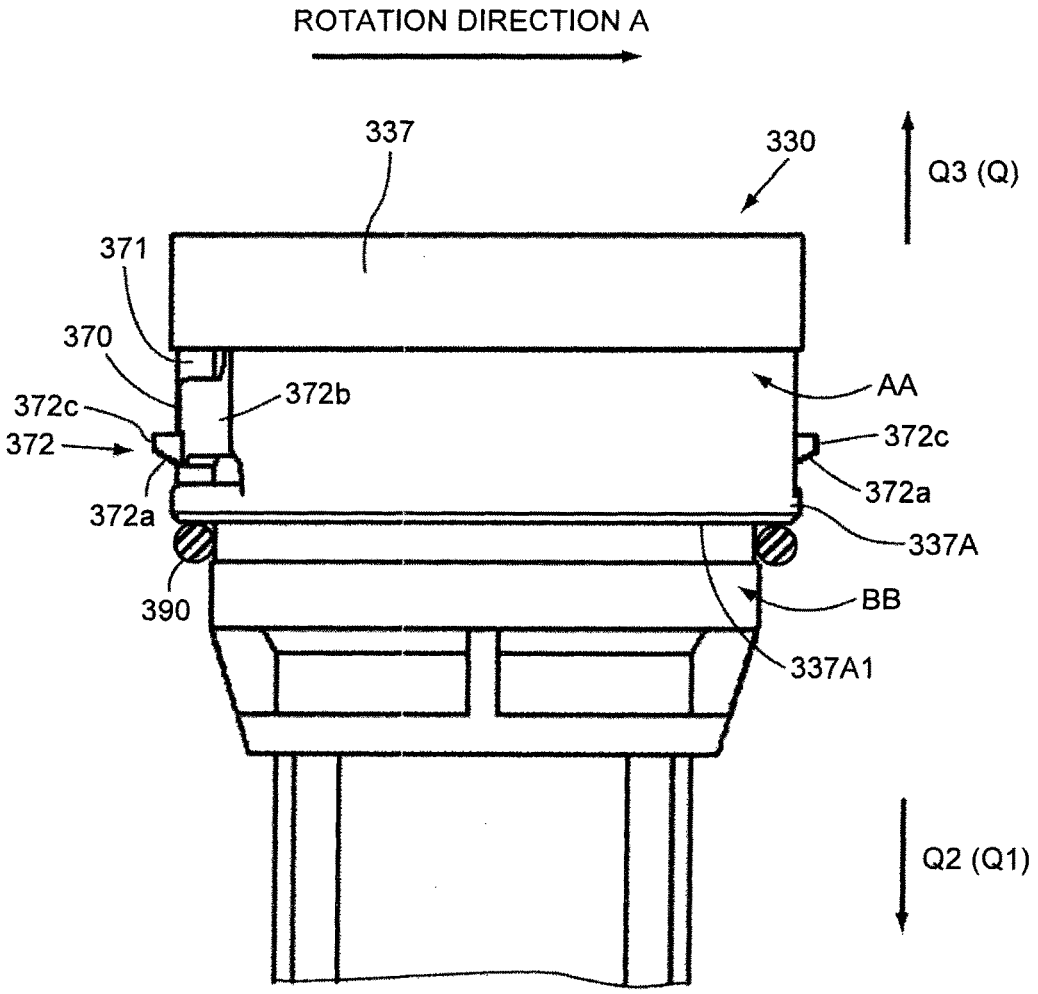
FIG. 16 is an enlarged view for explaining a configuration of an engaging portion provided on the nozzle receiver.
Figure 17:
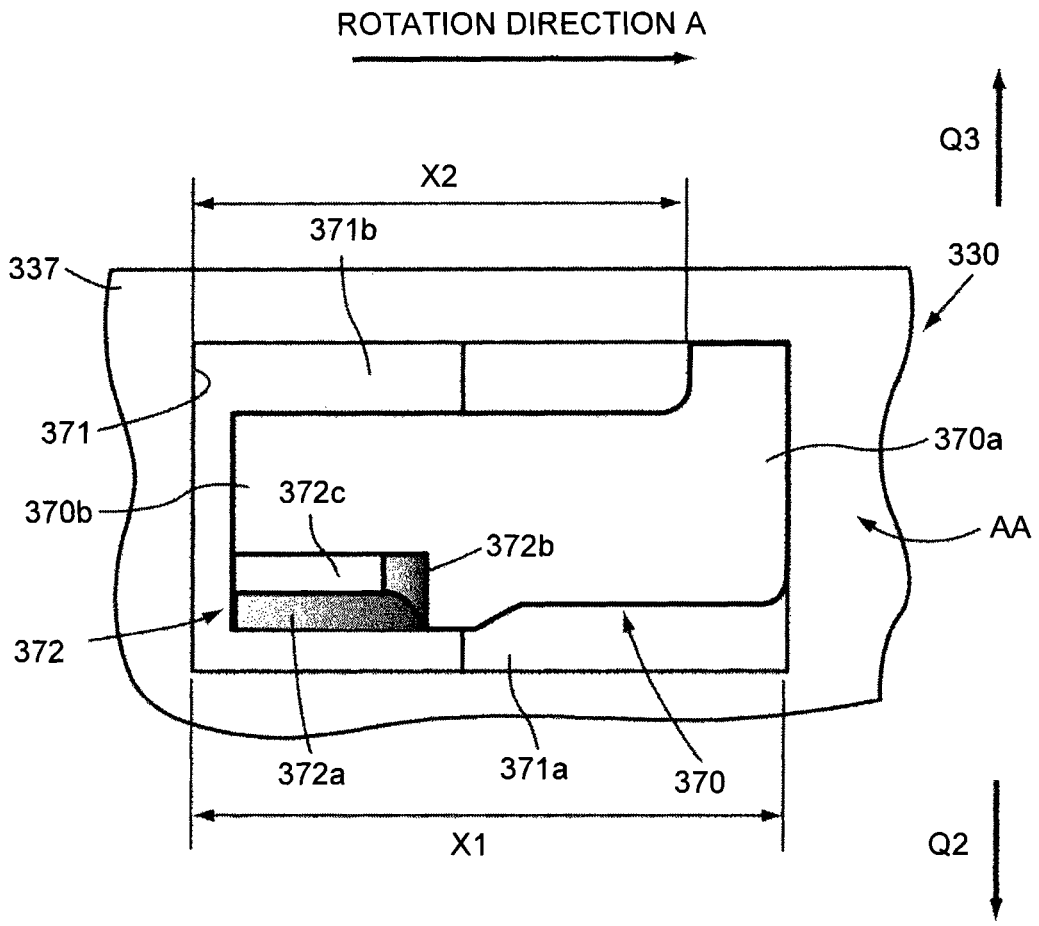
FIG. 17 is an enlarged view for explaining configurations of the engaging portion and a cutout portion provided on the nozzle insertion member.

To address the above described issues, in the embodiment, a resilient engaging method is employed as the method of attaching the nozzle receiver 330 and the container body 33, instead of a press fitting method and a fastening method. This configuration will be described below mainly with reference to FIGS. 13A, 13B, 15A to 15C, 16, and 17. FIG. 13A is a diagram illustrating a state in which the container body 33 and the nozzle receiver 330 are attached to each other. FIG. 13B is an enlarged view of an attaching portion of the container body 33 and the nozzle receiver 330. FIG. 15A is a side view of the nozzle receiver 330 from which the container shutter 332 is removed. FIG. 15B is a front view of the nozzle receiver 330 in FIG. 15A when viewed in an axial direction. FIG. 15C is a cross-sectional view taken along a line K-K in FIG. 15B. FIG. 16 is an enlarged view for explaining a configuration of an engaging portion provided on the nozzle receiver attachment portion 337 of the nozzle receiver 330. FIG. 17 is an enlarged view for explaining a configuration of the engaging portion and the cutout portion provided on the nozzle receiver attachment portion 337.

The nozzle receiver 330 illustrated in FIGS. 15A to 15C and 16 includes a flexible piece 370 serving as an engaging piece or an engaging portion. The flexible piece 370 is engaged with a hole 380 serving as an engaged portion by being resiliently displaceable. The hole 380 is provided inside the container opening 33*a* as illustrated in FIG. 13A.

The flexible piece 370 is located on the outside of the receiving opening 331 serving as the nozzle receiving opening in a radial direction H. The radial direction H is a crossing direction perpendicular to an attachment direction Q2 of the nozzle receiver 330. The flexible piece 370 is disposed inside a cutout portion 371 provided on the wall of the nozzle receiver 330 facing the inner surface 33*a*1 of the container opening 33*a*. In other words, the flexible piece 370 is disposed on the wall of the nozzle receiver 330 facing the engaged portion on the outside of the receiving opening 331 in a direction perpendicular to the longitudinal direction of the toner container 32. One end 370*a* of the flexible piece 370 serves as a base end and is supported inside the cutout portion 371. Specifically, one end 370*a* of the flexible piece 370 is connected to the wall of the nozzle receiver 330 facing the engaged portion. Other end 370*b* of the flexible piece 370 serves as a free end and is resiliently displaceable in a J direction so as to move back and forth with respect to the hole 380. It is sufficient that at least one flexible piece 370 and one hole 380 are provided. In the embodiment, the two flexible pieces 370 and the two holes 380 are provided at an interval of 180 degrees. The flexible pieces 370 have the same configuration and the holes 380 have the same configuration. Therefore, a pair of the flexible piece 370 and the hole 380 will be described below.

In the embodiment, the attachment direction Q2 is the same as the detachment direction Q1 in which the toner container 32 is detached from the toner replenishing device 60. A detachment direction Q3 of the nozzle receiver 330 is the same as the attachment direction Q in which the toner container 32 is attached to the toner replenishing device 60. The wall of the nozzle receiver 330 facing the inner surface 33*a*1 of the container opening 33*a* is the nozzle receiver attachment portion 337, where the outer surface AA and the inner surface DD of the nozzle receiver 330 are provided as illustrated in FIG. 12. The J direction, in which the flexible piece 370 moves back and forth with respect to the hole 380, is a thickness direction of a portion where the outer surface AA and the inner surface DD of the nozzle receiver attachment portion 337 are located. The J direction is the same as the radial direction H.

The one end 370*a* of the flexible piece 370 is disposed on a first side portion 371*a* located on the downstream side in a rotation direction A of the container body 33 relative to the other end 370*b* inside the cutout portion 371. The flexible piece 370 extends from the downstream side to the upstream side in the rotation direction A of the container body 33. In other words, the flexible piece extends from the wall along the inner surface 33*a*1 of the container opening 33*a*. The flexible piece 370 is integrally formed with the nozzle receiver attachment portion 337 in the cutout portion 371 such that the one end 370*a* thereof is connected to the nozzle receiver attachment portion 337. Such flexible piece 370 is obtained by forming the cutout portion 371 in a U-shape on the nozzle receiver attachment portion 337 so as to penetrate through the outer surface AA and the inner surface DD. Thereby, the other end 370*b* of the flexible piece 370 is a free end defined by the cutout portion 371 provided on the wall. The flexible piece 370 is configured so as to be resiliently displaced toward the outer surface AA and the inner surface DD of the nozzle receiver attachment portion 337 by using the one end 370*a* as a fulcrum, where the outer surface AA and the inner surface DD are located in the direction J in which the other end 370*b* moves back and forth.

As illustrated in FIGS. 11, 12, 15A, and 15B, the flexible piece 370 includes a protrusion (guiding portion) 372 on the other end 370*b*. The protrusion 372 protrudes outward from the flexible piece 370 more than the outer surface AA in the radial direction H (toward the inner surface 33*a*1 of the container opening 33*a*). The protrusion 372 is inserted in and removed from the hole 380. With this insertion and removal of the protrusion 372, the flexible piece 370 is engaged with and disengaged from the hole 380.

As illustrated in FIGS. 13A and 13B, the hole 380 is a quadrangular hole penetrating from the inner surface 33*a*1 to the outer surface 33*b* of the container opening 33*a*. The engaged portion is not necessarily have to be a hole penetrating from the inner surface 33*a*1 to the outer surface 33*b*. The engaged portion may be provided as a recess from the inner surface 33*a*1 to the outer surface 33*b* as long as an engaged state of the flexible piece 370 can be ensured. The shape of the hole 380 serving as the engaged portion is not limited to a quadrangular shape as long as the hole 380 is large enough to insert the other end 370*b* (the protrusion 372) of the flexible piece 370.

As described above, the nozzle receiver attachment portion 337 of the nozzle receiver 330 includes the resiliently displaceable flexible piece 370 that is engaged with the hole 380, which is provided inside the container opening 33*a* of the container body 33. With this configuration, when the nozzle receiver 330 is to be detached from the container body 33 (from the inside of the container opening 33*a*), it is possible to release the engaged state of the flexible piece 370 and the hole 380 by resiliently displacing the flexible piece 370 toward the inner surface BB of the nozzle receiver attachment portion 337, that is, in a direction in which the flexible piece 370 is disengaged from the hole 380. Therefore, a stress applied to the container body 33 and the nozzle receiver 330 when the nozzle receiver 330 is detached from the container opening 33*a* of the container body 33 in the detachment direction Q3 can be reduced. Consequently, it is possible to easily detach the nozzle receiver 330 from the container body 33 without damaging parts, such as the container body 33, of the toner container 32, enabling to reuse the container body 33 and the nozzle receiver 330.

As illustrated in FIG. 16, the protrusion 372 protruding from the outer surface AA includes a first inclined portion (first guiding portion) 372*a* and a second inclined portion (second guiding portion) 372*b*. The first inclined portion 372*a* is inclined downward to the downstream side in the attachment direction Q2 in which the nozzle receiver 330 is attached to the container body 33. As illustrated in FIG. 17, the second inclined portion 372*b* is inclined downward to the downstream side in the rotation direction A of the container body 33.

The first inclined portion 372*a* is inclined in a direction in which the first inclined portion 372*a* spreads out from the outer surface AA of the nozzle receiver attachment portion 337 located on the downstream side in the attachment direction Q2 relative to the first inclined portion 372*a* toward a top surface 372*c* located on the downstream side in the detachment direction Q3 relative to the first inclined portion 372*a*.

Therefore, when the nozzle receiver 330 is moved in the attachment direction Q2, in which the nozzle receiver 330 is attached to the container body 33, and pushed into the container opening 33*a* of the container body 33, the first inclined portion 372*a* is pushed by the inner surface 33*a*1, so that the flexible piece 370 is pushed toward the inner surface DD. Therefore, when the nozzle receiver 330 is attached to the container body 33, the nozzle receiver 330 can be attached without being hooked by the protrusion 372. Then, when the protrusion 372 faces the hole 380, the protrusion 372 is restored by the restoring force of the flexible piece 370 having been pushed, and is inserted in and engaged with the hole 380. Therefore, it is possible to infallibly attach and hold the nozzle receiver 330 in the container body 33.

The second inclined portion 372*b* is an upward inclined surface, which is inclined upward from the outer surface AA of the nozzle receiver attachment portion 337 located on the downstream side in the rotation direction A of the container body 33 relative to the second inclined portion 372*b* toward the top surface 372*c* located on the upstream side in the rotation direction A of the second inclined portion 372*b* relative to the second inclined portion 372*b*. Therefore, when the nozzle receiver 330 is detached from the container opening 33*a*, the nozzle receiver 330 can easily be detached by rotating the nozzle receiver 330 or the container body 33 (the container opening 33*a*) along the second inclined portion 372*b*. While the first inclined portion 372*a* and the second inclined portion 372*b* are provided as the inclined surfaces, they may be curved surfaces.

As illustrated in FIG. 17, the U-shaped cutout portion 371 includes the first side portion 371*a* and a second side portion 371*b*. The first side portion 371*a* is located on the downstream side in the attachment direction Q2 relative to the flexible piece 370. The second side portion 371*b* is located on the downstream side in the detachment direction Q3, in which the nozzle receiver 330 is detached from the container body 33, that is, on the upstream side in the attachment direction Q2, relative to the flexible piece 370. In other words, the first side portion 371*a* and the second side portion 371*b* are located on both sides of the flexible piece 370. A length X2 of the second side portion 371*b* is smaller than a length X1 of the first side portion 371*a* in the rotation direction A of the container body 33. Therefore, the rigidity of the flexible piece 370 is higher on the second side portion 371*b* side than on the first side portion 371*a* side. Consequently, it becomes possible to improve a margin to prevent the nozzle receiver 330 from coming off in the detachment direction Q3 due to a repulsive force from the O ring 390, and distribute the repulsive force from the O ring 390.

Further, in the embodiment, the nozzle receiver 330 is not attached to the container body 33 by fastening using a screw. Therefore, the O ring 390 is not twisted due to interference between the nozzle receiver 330 and the O ring 390. Consequently, the sealing function of the O ring 390 is not impaired. Furthermore, the O ring 390 is disposed on the container inner side relative to the engaging position of the flexible piece 370, which serves as the engaging piece or the engaging portion, and the hole 380, which serves as the engaged portion. Therefore, the O ring 390 does not cause interference when the flexible piece 370 and the hole 380 are engaged with or disengaged from each other. Namely, the engaging position and the position of the O ring 390 are offset in the rotation axis direction of the container body 33. Therefore, the O ring 390 is not damaged and the sealing function thereof can be maintained when the flexible piece 370 and the hole 380 are engaged with or disengaged from each other.

Figure 18:
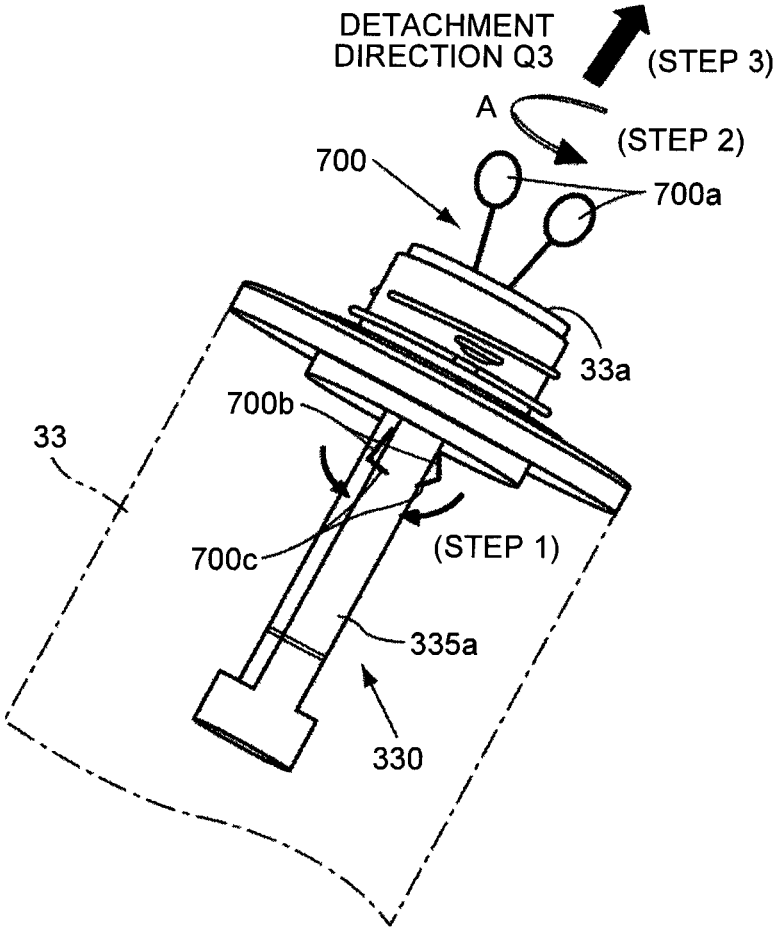
FIG. 18 is a perspective view for explaining an example of a jig and the way to remove the nozzle receiver from the powder container.

To detach the nozzle receiver 330 from the container, body 33, a jig 700 as illustrated in FIG. 18 is used. The jig 700 has a scissors shape, in which one ends 700*a* and other ends 700*b* are opened and closed in a diagonal manner. Front edges 700*c* of the other ends 700*b* are bent inward such that the nozzle receiver 330 can be hooked thereon, for example.

An operator inserts the other ends 700*b* of the jig 700 in the container body 33 while pushing away the container shutter 332 of the nozzle receiver 330 from a container opening 30*a* side, and operates the one ends 700*a* to grip the shutter side supporting portion 335*a* with the front edges 700*c* of the other ends 700*b* (Step 1). Subsequently, the container body 33 is rotated while the shutter side supporting portion 335*a* is gripped (Step 2). Then, the nozzle receiver 330 is pulled out from the container body 33 in the detachment direction Q3 (Step 3).

Through the operation procedure as described above, it is possible to easily detach the nozzle receiver 330 from the container body 33 (the container opening 33*a*). The rotation direction at Step 2 is the same as the rotation direction A of the container body 33 on the one end 370*a* side of the flexible piece 370. By the rotation in this direction, the other end 370*b* of the flexible piece 370 is resiliently displaced in a direction in which the other end 370*b* is pushed toward the inner surface DD by the inner surface 33*a*1. Therefore, it is possible to easily release the engaged state of the hole 380 and the protrusion 372, enabling to easily detach the nozzle receiver 330 without damage.

In the above described embodiment, the rotation direction A of the container body 33 is a counterclockwise direction when viewed from the printer 100. However, depending on the toner container or the configuration of the apparatus, the rotation direction A of the container body 33 may be a clockwise direction when viewed from the printer 100. This configuration is enabled by reversing the flexible piece 370, which serves as the engaging piece or the engaging portion, and the cutout portion 371 from those of the embodiment.

According to an embodiment, when a nozzle insertion member is detached from a powder storage, an engaging portion and an engaged portion are disengaged from each other by resiliently displacing the engaging portion in a direction in which the engaging portion is disengaged from the engaged portion. Therefore, it is possible to reduce a stress applied to the powder storage and the nozzle insertion member at the time of attachment and detachment of the nozzle insertion member. Consequently, it becomes possible to easily detach the nozzle insertion member from the powder storage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The advantageous effects described in the embodiment are the preferable effects that may be obtained by the present invention, and are not limited to those described herein.

The present invention further includes the following aspects.

Aspect 1

A powder container comprising:

a powder storage that stores therein powder to be supplied to a powder conveying device and that rotates so as to convey the powder from one end to other end of the powder storage in a longitudinal direction of the powder storage, the other end of the powder storage being provided with an opening; and a nozzle insertion member that includes a nozzle insertion opening in which a conveying nozzle provided in the powder conveying device is inserted and that is detachably attached to the opening, wherein the nozzle insertion member includes an engaging portion that is engaged with an engaged portion provided inside the opening by being resiliently displaced.

Aspect 2

The powder container according to Aspect 1, wherein the engaging portion is an engaging piece, the engaging piece being located on an outside of the nozzle insertion opening in a direction crossing an attachment direction of the nozzle insertion member, disposed inside a cutout portion provided on a wall facing an inner surface of the opening, and resiliently displaceable such that one end of the engaging piece is supported inside the cutout portion and other end moves back and forth with respect to the engaged portion.

Aspect 3

The powder container according to Aspect 2, wherein the one end of the engaging piece is disposed on a downstream side in a rotation direction of the powder container relative to the other end inside the cutout portion, and extends from the downstream side to an upstream side in the rotation direction.

Aspect 4

The powder container according to Aspect 3, wherein the other end of the engaging piece includes a protrusion that is inclined or curved in at least one of the attachment direction of the nozzle receiver and the rotation direction, and the protrusion protrudes outward from the wall in the direction crossing the attachment direction.

Aspect 5

The powder container according to any one of Aspects 2 to 4, wherein the cutout portion includes a first side portion and a second side portion, the first side portion is located on a downstream side in the attachment direction of the nozzle insertion member relative to the engaging piece, the second side portion is located on an upstream side in the attachment direction of the nozzle insertion member relative to the engaging piece, and a length of the second side portion is smaller than a length of the first side portion in the rotation direction of the powder container.

Aspect 6

The powder container according to any one of Aspects 1 to 5, further comprising:

a seal member that is interposed between the nozzle insertion member attached inside the opening and the inner surface of the opening, wherein the seal member is disposed on a container inner side relative to an engaging position of the engaging portion and the engaged portion.

Aspect 7

The image forming apparatus comprising the powder container according to any one of Aspects 1 to 6.

REFERENCE SIGNS LIST

28 REGISTRATION ROLLER PAIR
29 DISCHARGE ROLLER PAIR
30 STACK SECTION
32 (Y, M, C, K) TONER CONTAINER (POWDER CONTAINER)
33 CONTAINER BODY (POWDER STORAGE)
**33*a*** OPENING
**33*a*1** INNER SURFACE OF OPENING
**33*b*** OUTER SURFACE OF CONTAINER OPENING
34 CONTAINER COVER (CONTAINER FRONT END COVER, HOLDING PART)
**34*a*** GEAR EXPOSING OPENING
41 (Y, M, C, K) PHOTOCONDUCTOR (IMAGE BEARER)
42 (Y, M, C, K) CLEANING DEVICE (PHOTOCONDUCTOR CLEANING DEVICE)
**42*a*** CLEANING BLADE
44 (Y, M, C, K) CHARGING ROLLER (CHARGING DEVICE)
46 (Y, M, C, K) IMAGE FORMING SECTION (IMAGE FORMING UNIT)
47 EXPOSING DEVICE
48 INTERMEDIATE TRANSFER BELT
49 (Y, M, C, K) PRIMARY-TRANSFER BIAS ROLLER
50 DEVELOPING DEVICE
51 (Y, M, C, K) DEVELOPING ROLLER (DEVELOPER BEARER)
52 (Y, M, C, K) DOCTOR BLADE (DEVELOPER REGULATING PLATE)
53 (Y, M, C, K) FIRST DEVELOPER ACCOMMODATING SECTION
54 (Y, M, C, K) SECOND DEVELOPER ACCOMMODATING SECTION
55 (Y, M, C, K) DEVELOPER CONVEYING SCREW
56 (Y, M, C, K) TONER DENSITY SENSOR
60 (Y, M, C, K) TONER REPLENISHING DEVICE (POWDER CONVEYING DEVICE)
70 TONER CONTAINER HOLDER (CONTAINER HOLDING SECTION)
71 INSERTION HOLE PART
**71*a*** INSERTION HOLE
72 CONTAINER RECEIVING SECTION
73 CONTAINER COVER RECEIVING SECTION
**74*a*** SIDE SURFACE
**74*b*** SIDE SURFACE
75 GUIDE RAIL
78 REPLENISHING DEVICE ENGAGING MEMBER
82 SECONDARY-TRANSFER BACKUP ROLLER
85 INTERMEDIATE TRANSFER DEVICE
86 FIXING DEVICE
91 DRIVING PART (CONTAINER ROTATING PART)
100 PRINTER
200 SHEET FEEDER
301 CONTAINER GEAR (CONTAINER-SIDE GEAR)
302 SPIRAL RIB (ROTARY CONVEYOR)
303 GRIPPER
305 FRONT END OPENING
330 NOZZLE RECEIVER (NOZZLE INSERTION MEMBER)
331 RECEIVING OPENING (NOZZLE INSERTION OPENING)
332 CONTAINER SHUTTER (OPENING/CLOSING MEMBER)
**332*a*** SHUTTER HOOK (ENGAGED PORTION)
**332*c*** FRONT CYLINDRICAL PORTION (CLOSURE)
**332*d*** SLIDE AREA (GLIDING PORTION, SEALING PORTION)
**332*e*** GUIDING ROD (ELONGATED PORTION)
**332*g*** GUIDING ROD SLIDING PORTION
**332*h*** END SURFACE OF FRONT CYLINDRICAL PORTION
333 CONTAINER SEAL (SEAL)
334 CONTAINER SHUTTER SUPPORTER (SUPPORTER)

335 SHUTTER REAR END SUPPORTING PORTION (SHUTTER REAR PORTION)
335*a* SHUTTER SIDE SUPPORTING PORTION (SIDE PORTION)
335*b* OPENING OF SHUTTER SUPPORTING PORTION (SHUTTER SIDE OPENING)
335*c* END SURFACE PORTION OF SUPPORTER
335*ca* INNER WALL SURFACE
336 CONTAINER SHUTTER SPRING (BIASING MEMBER)
337 NOZZLE RECEIVER ATTACHMENT PORTION (WALL)
337*a* NOZZLE SHUTTER POSITIONING RIB
337A STEP PORTION
337A1 CONTACT SURFACE (SEAL RECEIVING SURFACE)
337B CONTACT SURFACE (SEAL RECEIVING SURFACE)
339 CONTAINER ENGAGING PORTION
339*a* GUIDING PROTRUSION
339*b* GUIDING GROOVE
339*c* BUMP
339*d* ENGAGING OPENING (AXIAL RESTRICTOR)
361 SLIDING GUIDE
370 FLEXIBLE PIECE (ENGAGING PIECE, ENGAGING PORTION)
370*a* ONE END (BASE END)
370*b* OTHER END (FREE END)
371 CUTOUT PORTION
371*a* FIRST SIDE PORTION
371*b* SECOND SIDE PORTION
372 PROTRUSION (GUIDING PORTION)
372*a* FIRST INCLINED PORTION (FIRST GUIDING PORTION)
372*b* SECOND INCLINED PORTION (SECOND GUIDING PORTION)
372*c* TOP SURFACE
380 HOLE (ENGAGED PORTION)
390 O RING
400 SCANNER
500 COPIER (IMAGE FORMING APPARATUS)
601 CONTAINER DRIVING GEAR (APPARATUS MAIN-BODY GEAR)
602 MOUNTING FRAME
603 DRIVING MOTOR
603 OUTPUT GEAR
604 COUPLED GEAR
605 CONVEYING SCREW GEAR
607 NOZZLE HOLDER
608 SETTING COVER
608*d* HOLE
610 NOZZLE HOLE
611 CONVEYING NOZZLE
611*a* FRONT END (END SURFACE) OF CONVEYING NOZZLE
612 NOZZLE SHUTTER
612*a* NOZZLE SHUTTER FLANGE
614 CONVEYING SCREW (MAIN BODY CONVEYOR)
615 CONTAINER SETTING SECTION (CONTAINER RECEIVING SECTION)
615*a* INNER SURFACE OF CONTAINER SETTING SECTION
615*c* SPRING SECURING SECTION
615*d* CONTACT SURFACE
700 JIG
782 TORSION COIL SPRING
P RECORDING MEDIUM
G DEVELOPER
A ROTATION DIRECTION OF POWDER CONTAINER
H CROSSING DIRECTION (RADIAL DIRECTION)
Q2 ATTACHMENT DIRECTION
Q3 DETACHMENT DIRECTION
AA OUTER SURFACE OF WALL
DD INNER SURFACE OF WALL
X1 LENGTH OF FIRST SIDE PORTION
X2 LENGTH OF SECOND SIDE PORTION

The invention claimed is:

1. A powder container, comprising:
a conveyor that is in the powder container and that conveys powder from one side to other side of the powder container in a longitudinal direction of the powder container, the powder container being provided with a cylindrical opening on the other side; and
a nozzle receiver that includes a nozzle receiving opening in which a conveying nozzle of a powder conveying device is inserted and that is attached to the cylindrical opening,
wherein:
the nozzle receiver includes an engaging portion that is engaged with an engaged portion provided inside the cylindrical opening,
the engaging portion includes an engaging piece disposed on a wall of the nozzle receiver,
the engaging piece extends from the wall along an inner surface of the cylindrical opening,
one end of the engaging piece is connected to the wall,
an other end of the engaging piece is a free end defined by a cutout portion provided on the wall, and
the engaging piece is resiliently displaceable.

2. The powder container according to claim 1, wherein
the conveyor of the powder container rotates about a rotation axis extending in the longitudinal direction, and
the one end of the engaging piece is on a downstream side in a rotation direction of the powder container relative to the other end.

3. The powder container according to claim 1, wherein
the engaging piece includes a protrusion on the other end, the protrusion protruding outward in the direction perpendicular to the longitudinal direction.

4. The powder container according to claim 3, wherein
the nozzle receiver is attached to the cylindrical opening of the powder container in the longitudinal direction, and
the protrusion has a surface that is inclined or curved downward from an upstream side to a downstream side in an attachment direction of the nozzle receiver.

5. The powder container according to claim 3, wherein
the protrusion has a surface that is inclined or curved upward from a downstream side to an upstream side in the rotation direction.

6. The powder container according to claim 3, wherein
the nozzle receiver is attached to the cylindrical opening of the powder container in the longitudinal direction,
the protrusion includes a first inclined portion and a second inclined portion,
the first inclined portion is inclined or curved upward from an upstream side to a downstream side in an attachment direction of the nozzle receiver, and
the second inclined portion is inclined or curved upward from a downstream side to an upstream side in the rotation direction.

7. The powder container according to claim 1, wherein
the nozzle receiver is attached to the cylindrical opening of the powder container in the longitudinal direction,
the cutout portion includes a first side portion and a second side portion,
the first side portion defines a downstream side of the engaging piece in an attachment direction of the nozzle receiver,
the second side portion defines an upstream side of the engaging piece in the attachment direction of the nozzle receiver, and
the first side portion is longer than the second side portion.

8. The powder container according to claim 1, further comprising:
a seal member that is interposed between an outer surface of the nozzle receiver and the inner surface of the cylindrical opening, wherein
the seal member is on a container inner side relative to an engaging position of the engaging portion and the engaged portion in the longitudinal direction.

9. The powder container according to claim 1, wherein the powder container stores therein toner as the powder.

10. The powder container according to claim 9, wherein the powder container further stores therein carrier.

11. The powder container according to claim 1, further comprising:
an approximately cylindrical powder storage that stores therein powder to be supplied to the powder conveying device.

12. An image forming apparatus comprising the powder container according to claim 1.

13. A nozzle receiver that is attached to an opening of a powder container used in an image forming apparatus and that includes a nozzle receiving opening in which a conveying nozzle of the image forming apparatus for conveying powder to be supplied from the powder container is inserted along a longitudinal direction of the powder container, the nozzle receiver comprising:
an engaging portion that is engaged with an engaged portion provided inside the opening,
wherein:
the engaging portion includes an engaging piece disposed on a wall,
one end of the engaging piece is connected to the wall,
an other end of the engaging piece is a free end defined by a cutout portion provided on the wall,
the engaging piece extends from the wall along an inner surface of the opening, and
wherein the engaging piece is resiliently displaceable.

14. The nozzle receiver according to claim 13, further comprising:
a shutter to move to an opening position to open the nozzle receiving opening by being pressed with insertion of the conveying nozzle, and to move to a closing position to close the nozzle receiving opening with removal of the conveying nozzle;
a supporter to support the shutter to guide movement of the shutter to the opening position and the closing position; and
a biasing member that is on the supporter to bias the shutter to the closing position,
wherein the shutter is rotated by a drive transmitting unit with rotation of the supporter.

15. The nozzle receiver according to claim 13, further comprising:
a shutter to move to an opening position to open the nozzle receiving opening by being pressed with insertion of the conveying nozzle, and to move to a closing position to close the nozzle receiving opening with removal of the conveying nozzle;
a supporter to support the shutter to guide movement of the shutter to the opening position and the closing position;
a biasing member that is on the supporter to bias the shutter to the closing position; and
a protrusion that protrudes from an end surface of the shutter and that comes in contact with an end surface of the conveying nozzle,
wherein the shutter rotates with rotation of the supporter.

16. The nozzle receiver according to claim 13, wherein the powder container stores therein toner as the powder.

17. The nozzle receiver of claim 13, wherein the powder container further stores therein carrier.

18. A powder container, comprising:
the powder container of claim 13; and
the nozzle receiver of claim 13.

19. An image forming apparatus, comprising:
the image forming apparatus of claim 13;
the powder container of claim 13; and
the nozzle receive of claim 13.

* * * * *